US009812240B2

(12) United States Patent
Koren

(10) Patent No.: US 9,812,240 B2
(45) Date of Patent: Nov. 7, 2017

(54) HANDHELD PORTABLE MAGNETIZER DEVICE, SYSTEM, AND METHOD

(71) Applicant: MAGNUM MAGNETICS CORPORATION, Marietta, OH (US)

(72) Inventor: Trygve Koren, Newport, OH (US)

(73) Assignee: Magnum Magnetics Corporation, Marietta, OH (US)

( * ) Notice: Subject to any disclaimer, the term of this patent is extended or adjusted under 35 U.S.C. 154(b) by 49 days.

(21) Appl. No.: 14/727,218

(22) Filed: Jun. 1, 2015

(65) Prior Publication Data

US 2016/0351312 A1 Dec. 1, 2016

(51) Int. Cl.
*H01F 13/00* (2006.01)
*H01F 7/02* (2006.01)

(52) U.S. Cl.
CPC ..... *H01F 13/003* (2013.01); *H01F 7/0215* (2013.01)

(58) Field of Classification Search
CPC ..... H01F 13/003
See application file for complete search history.

(56) References Cited

U.S. PATENT DOCUMENTS

| | | | | |
|---|---|---|---|---|
| 8,174,346 | B1 * | 5/2012 | Koren | H01F 13/003 335/284 |
| 8,754,733 | B2 * | 6/2014 | Koren | H01F 13/003 335/284 |
| 9,472,331 | B2 * | 10/2016 | Lefevre | H01F 13/003 |
| 2008/0224806 | A1 * | 9/2008 | Ogden | H01F 13/003 335/284 |
| 2012/0188036 | A1 * | 7/2012 | Koren | H01F 13/003 335/284 |

* cited by examiner

*Primary Examiner* — Mohamad Musleh
(74) *Attorney, Agent, or Firm* — Vorys, Sater, Seymour and Pease LLP; William L. Klima

(57) ABSTRACT

A hand held portable magnetizer device, system, and method for magnetizing magnetizable sheets for on-site use.

21 Claims, 19 Drawing Sheets

HANDHELD PORTABLE MAGNETIZER DEVICE, SYSTEM, AND METHOD

FIELD

A hand held portable magnetizer device, system and method for magnetizing sheet material. For example, the hand held portable magnetizer device can be used to magnetize flexible magnetizable sheet material on-site.

BACKGROUND

The device, system, and method relate to magnetizing flexible magnetizable sheet material. The device and system can include a portable magnetizer, and the method includes using a portable magnetizer.

More particularly, the device, system, and method relate to providing a portable magnetizer for magnetizing batches of magnetizable sheets or sheet material Typically, magnetizing of magnetizable sheeting is either conducted during manufacture or in large scale production lines. When only a small batch of sheets needs magnetizing, it is inefficient to utilize large scale production lines and/or methods of magnetization. A high-volume production magnetizer is expensive, and may take up too much space for the benefit of smaller scale, occasional use on-site. Likewise, taking a batch of sheets in to a high-volume production company for magnetization slows down production and consequently the high-volume production company charges increased fees. A device, system, and method are needed to magnetize sheets on-site, for less cost, in a portable and space saving manner.

SUMMARY

A device, system, and method for overcoming the above-mentioned problem.

A hand held portable high energy magnetizer device for magnetizing flexible magnetizable sheet material, the device comprising or consisting of a housing configured or arranged to be placed in contact with the flexible magnetizable sheet material, and then gripped by a user and motivated along a length of the flexible magnetizable sheet while maintaining contact therebetween; and a magnetizer disposed within the housing, the magnetizer configured or arranged to multipole magnetize the flexible magnetizable sheet, the magnetizer comprising a magnetic field source with alternating pattern of pole pairs.

A hand held portable high energy magnetizer device comprising or consisting of a housing and a magnetizer comprises at least one magnetic roller rotatably connected to the housing.

A hand held portable high energy magnetizer device comprising or consisting of a housing and a magnetizer comprises at least one magnetic roller rotatably connected to the housing, the magnetic roller being configured or arranged to freely rotate within the housing.

A hand held portable high energy magnetizer device comprising or consisting of a housing and a magnetizer comprises at least one magnetic roller rotatably connected to the housing, the magnetizer comprising a pair of spaced apart magnetic rollers connected to the roller.

A hand held portable high energy magnetizer device comprising or consisting of a housing and a magnetizer comprising at least one magnetic roller rotatably connected to the housing, the at least one magnetic roller comprising a plurality of spaced apart magnetic stacks separated by a stripper plate.

A hand held portable high energy magnetizer device comprising or consisting of a housing and a magnetizing comprising at least one magnetic roller rotatably connect to the housing, the at least one magnetic stack comprising a pair of magnetic stacks arranged side-by-side.

A hand held portable high energy magnetizer device comprising or consisting of a housing and a magnetizer comprising at least one magnetic roller rotatably connected to the housing, the at least one magnetic roller being disposed within a recess located in a bottom side of the housing.

A hand held portable high energy magnetizer device comprising or consisting of a housing and a magnetizer comprising at least one magnetic roller rotatably connected to the housing, the at least one magnetic roller comprising a plurality of spaced apart magnetic stacks separated by stripper plates, the magnetic roller and stripper plates being disposed within recesses located on a bottom side of the housing.

A hand held portable high energy magnetizer device comprising or consisting of a housing and a magnetizer comprising at least one magnetic roller rotatably connected to the housing, the at least one magnetic roller being a pair of spaced apart magnetic rollers each located within a recess located in the bottom side of the housing.

A hand held portable high energy magnetizer device comprising or consisting of a housing and a magnetizer comprising at least one magnetic roller rotatably connected to the housing, the at least one magnetic roller comprising a plurality of spaced apart magnetic stacks separated by stripper plates, the magnetic roller and stripper plates being disposed within recesses located on a bottom side of the housing, the stripper plates on one magnetic roller being offset from the stripper plates on the other magnetic roller.

A hand held portable high energy magnetizer device comprising or consisting of a housing and a magnetizer comprising at least one magnetic roller rotatably connected to the housing, the at least one magnetic roller comprising a plurality of spaced apart magnetic stacks separated by stripper plates, the magnetic roller and stripper plates being disposed within recesses located on a bottom side of the housing, the stripper plates on one magnetic roller being offset from the stripper plates on the other magnetic roller, the stripper plates having inner ends located in alternating recess along a center support located on the bottom side of the housing.

A hand held portable high energy magnetizer device comprising or consisting of a housing and a magnetizer comprising at least one magnetic roller rotatably connected to the housing, the housing comprises a center portion connected to opposite end plates.

A hand held portable high energy magnetizer device comprising or consisting of a housing and a magnetizer comprising at least one magnetic roller rotatably connected to the housing, the at least one magnetizer roller comprises at least one magnet stack supported on a shaft, the shaft having ends supported by the end plates of the housing.

A hand held portable high energy magnetizer device comprising or consisting of a housing and a magnetizer comprising at least one magnetic roller rotatably connected to the housing, the at least one magnetizer roller comprises at least one magnet stack supported on a shaft, the shaft having ends supported by the end plates of the housing, further comprising a bearing disposed within each end plate of the housing to rotatably support the ends of the shaft.

A hand held portable high energy magnetizer device comprising or consisting of a housing and a magnetizer comprising at least one magnetic roller rotatably connected to the housing, the magnetizer comprises at least one permanent magnet.

A hand held portable high energy magnetizer device comprising or consisting of a housing and a magnetizer comprising at least one magnetic roller rotatably connected to the housing and having a longitudinal axis, the magnetizer roller comprising a plurality of discrete field-producing lamination-sets spaced along the longitudinal axis of the magnetizer roller, each discrete field-producing lamination-set comprising at least one circular magnetic disk and at least one circular flux-conducting spacer magnetically coupled with the at least one circular magnetic disk, each said at least one circular magnetic disk and each the circular flux-conducting spacers being coaxial with the longitudinal axis of the magnetizer roller.

A hand held portable high energy magnetizer device comprising or consisting of a housing and a magnetizer comprising at least one magnetic roller rotatably connected to the housing, the at least one magnetic roller extending below the bottom side of the housing to support the movement of the housing along the flexible magnetizable sheet material while maintaining contact of the magnetic roller with one side of the flexible magnetizable sheet.

A hand held portable high energy magnetizer system for magnetizing flexible magnetizable sheet material, the device comprising or consisting of a work support for supporting the magnetizable sheet of material; and a hand held portable high energy magnetizer device, including a housing configured or arranged to be placed in contact with the flexible magnetizable sheet material, and then gripped by a user and motivated along a length of the flexible magnetizable sheet while maintaining contact therebetween; and a magnetizer disposed within the housing, the magnetizer configured or arranged to multipole magnetize the flexible magnetizable sheet, the magnetizer comprising a magnetic field source with alternating pattern of pole pairs.

A hand held portable high energy magnetizer system for magnetizing flexible magnetizable sheet material, the device comprising or consisting of a work support for supporting the magnetizable sheet of material; and a hand held portable high energy magnetizer device, including a housing configured or arranged to be placed in contact with the flexible magnetizable sheet material, and then gripped by a user and motivated along a length of the flexible magnetizable sheet while maintaining contact therebetween; and a magnetizer disposed within the housing, the magnetizer configured or arranged to multipole magnetize the flexible magnetizable sheet, the magnetizer comprising a magnetic field source with alternating pattern of pole pairs, the work support being configured or arranged to hold the flexible magnetizable sheet material stationary when being magnetized by the hand held portable high energy magnetizer device.

A hand held portable high energy magnetizer system for magnetizing flexible magnetizable sheet material, the device comprising or consisting of a work support for supporting the magnetizable sheet of material; and a hand held portable high energy magnetizer device, including a housing configured or arranged to be placed in contact with the flexible magnetizable sheet material, and then gripped by a user and motivated along a length of the flexible magnetizable sheet while maintaining contact therebetween; and a magnetizer disposed within the housing, the magnetizer configured or arranged to multipole magnetize the flexible magnetizable sheet, the magnetizer comprising a magnetic field source with alternating pattern of pole pairs, the work support is configured or arranged to move the flexible magnetizable sheet material when being magnetized by the hand held portable high energy magnetizer device being held stationary by a user.

A method of magnetizing a flexible magnetizable sheet of material comprising or consisting of placing the flexible magnetizable sheet of material on a work support; placing a hand held portable high energy magnetizer device in contact with one side of the flexible magnetizable sheet of material; and moving the flexible magnetizable sheet of material and hand held portable high energy magnetizer relative to each other.

A method of magnetizing a flexible magnetizable sheet of material comprising or consisting of placing the flexible magnetizable sheet of material on a work support; placing a hand held portable high energy magnetizer device in contact with one side of the flexible magnetizable sheet of material; and moving the flexible magnetizable sheet of material and hand held portable high energy magnetizer relative to each other, the user then moving the hand held portable high energy magnetizer over the flexible magnetizable sheet of material held stationary on the work support.

A device and system comprising a portable storage case.

A device and system comprising or consisting of a rotating magnetic roller to magnetize magnetizable planar sheets.

A device or system for magnetizing magnetizable planar sheets that is capable of being carried by hand.

A device or system for magnetizing magnetizable planar sheets comprising or consisting of a magnetic roller of discrete field-producing laminations.

A device or system for magnetizing magnetizable planar sheets comprising or consisting of a magnetic roller of discrete field-producing laminations and sheet decouplers to separate the magnetized sheets from the magnetic roller.

A device or system for magnetizing magnetizable planar sheets comprising or consisting of a magnetic field between 4000 Gauss and 6000 Gauss.

A device or system for magnetizing magnetizable planar sheets having a width of less than 13 inches.

A device or system capable of high-energy magnetization of a high-energy magnetizable sheet.

A device or system for magnetizing magnetizable planar sheets that is efficient, inexpensive, and handy.

Other objects and features of this invention will become apparent with reference to the following descriptions.

The hand held portable high energy magnetizer device is configured or arranged to be a hand held unit that can be gripped by a user. The user can grip the hand held portable high energy magnetizer device and then move same relative to a stationary magnetizable sheeting material, or can hold the hand held portable high energy magnetizer device stationary as the magnetizable sheeting material is moved. In any event, there needs to be relative movement between the hand held portable high energy magnetizer device and the magnetizable sheeting material during the magnetizing process. Further, the magnet roller or magnet bar of the hand held portable high energy magnetizer should be placed in contact with surface on one side of the magnetizable sheeting material to make the magnetizing most effective.

The hand held portable high energy magnetizer device comprises on consist of a housing and a magnetic roller or magnetic bar. The magnetic roller or magnetic bar is connected to the housing so that at least a portion of the magnetic roller or magnetic bar is exposed to make contact with the magnetizable sheeting material.

For example, the hand held portable high energy magnetizer device comprises or consist of at least one magnetic roller connected to the housing (e.g. at least partially disposed within the housing) so that the magnetic roller can rotate relative to the housing. For example, the at least one magnetic roller can be disposed within a recess in the housing so that only a portion of the at least magnetic roller is exposed of application to the magnetizable sheeting material when is use. In this manner, the magnetic roller can be placed in contact with the surface of the magnetizable sheeting material, and then the housing can be gripped and pushed or pull to translate the hand held portable high energy magnetizer device relative to the surface of the magnetizable sheeting material.

For example, the hand held hand held portable high energy magnetizer device can comprise or consist of a pair of spaced apart magnetic rollers disposed within a pair of spaced apart recesses in the housing (e.g. bottom side thereof). Each magnetic roller can comprise of one or more magnet stacks mounted on a shaft and disposed along a length of the magnetic roller. For example, a pair of magnet stacks can be positioned side-by-side and spaced apart from another pair of magnet stacks by stripper plates. The stripper plates can also be disposed within recesses in the housing (e.g. bottom side thereof). The stripper plates can also be mount on the shaft (e.g. via through holes); however, the shaft of each magnetic roller is free to move relative to the stripper plates.

The magnetic rollers can each be made of alternating circular permanent magnets and spacers (e.g. steel washers). For example, the circular permanent magnets are arranged so that the polarity alternates along the length of the magnetic stack and roller.

The housing of the hand held portable high energy magnetizer device can be made of plastic material formed in various ways (e.g. 3D printing, injection molded, extruded, machined, etc.). For example, the housing is made with a center portion connected to two end plates. The end plates can be attached, for example, by fastener, adhering, heat welding, snap fit connection, etc. The end plates can be configured or arranged to accommodate bearings (e.g. ball bearings) to accommodate the ends of the shafts of the magnetic rollers. The housing can be formed to provide the recesses for accommodating the magnetic roller and recesses for accommodating the stripper plates. For example, the stripper plates on one magnetic roller are offset from the stripper plates on the other magnetic roller. In this manner, the spaced apart magnetic rollers can be located closer together reducing the width of the hand held high energy magnetizer device. This results, for example, in a zigzag-shaped center support (e.g. on the bottom side of the housing) due to the alternating recesses and spacing between recesses due to the offset stripper plates on the adjacent magnetic rollers.

The hand held portable high energy magnetizer device can be configured so that the at least one magnetic roller rotates freely and is not powered (i.e. no motor and/or drive to drive the at least one magnetic roller. In this manner, the at least one magnetic roller is driven by placing the at least one magnetic roller in contact with the surface on one side of the magnetizable sheeting material, and then moving the hand held portable high energy magnetizer relative to the magnetizable sheeting material. For example, the magnetizable sheet material is laid on a stationary work support, and then the hand held portable high energy magnetizer is placed on top of the magnetizable sheeting material and then pushed or pulled by the user moving the hand held portable high energy magnetizer over the surface of the magnetizable sheeting material.

The hand held portable high energy magnetizer system can comprise or consist of the hand held portable high energy magnetizer device along with a work support for supporting the magnetizable sheeting material during magnetizing. For example, the work support can be a steel sheet (e.g. ¼" Cold Rolled steel sheet). To get high energy pulls from the magnetic sheet, the magnetizable sheeting material needs to be on the steel sheet while the magnetizer is in use, or otherwise full strength cannot be achieved.

A device or system for magnetizing at least one planar sheet of flexible magnetizable material. For example, the device and system comprises or consist of a magnetizer for providing at least one magnetic field source; a positioner for positioning at least one planar sheet into at least one magnetizing interaction relationship with the magnetizer; an enclosure for enclosing the magnetizer and the positioner; and a hand-carrier for permitting hand-carrying of the enclosure means.

The device or system can further comprise or consist of an axial-holder for axially-holding the magnetizer along a single longitudinal axis. Additionally, it can further comprise or consist of a rotary movement generator for generating rotary movement of the axial-holder means.

The device or system, for example, can further comprise or consist of an enclosure such as a securable briefcase for providing briefcase-securing of such enclosure.

The device or system for magnetizing at least one planar sheet of flexible magnetizable material can comprise or consist of at least one magnetizer structured and arranged to provide at least one magnetic field source; at least one positioner structured and arranged to permit positioning of the at least one planar sheet into at least one magnetizing interaction relationship with the at least one magnetizer; at least one enclosure structured and arranged to enclose the at least one magnetizer and the at least one positioner; and at least one hand-carrier configured or arranged to permit hand-carrying of the at least one enclosure. The device and system, for example, can include at least one magnetizer having at least one permanent magnet.

The magnetizer, for example, can comprise or consist of at least one magnetizer bar having at least one longitudinal axis. The at least one magnetizer bar can comprise or consist of a plurality of discrete field-producing lamination-sets spaced along the at least one longitudinal axis. Each discrete field-producing lamination-set comprising or consisting of at least one circular magnetic disk and at least one circular flux-conducting spacer magnetically coupled with the at least one circular magnetic disk. Each at least one circular magnetic disk and each such at least one circular flux-conducting spacer can be coaxial with the at least one first longitudinal axis. Further, the device and system can further comprise or consist of at least one axial-holder structured and arranged to axially-hold such at least one magnetizer bar along such at least one longitudinal axis.

The device or system can further comprise or consist of at least one rotary movement generator configured or arranged to generate rotary movement of the at least one axial-holder and the at least one magnetizer bar. Moreover, the device and system can further comprise or consist of at least one magnetizer bar configured or arranged to magnetically couple to the at least one planar sheet to transfer movement to the at least one planar sheet. Additionally, the device and system can comprise or consist of at least one magnetizer bar configured or arranged to rotate for moving the at least one planar sheet through the at least one magnetic field.

Also, the device or system can further comprise or consist of at least one planar sheet decoupler configured or arranged to decouple the at least one planar sheet from the at least one magnetizer bar during movement of the at least one planar sheet through at least one magnetic field. In addition, the at least one magnetizer bar can be configured or arranged to rotate for moving the at least one planar sheet through the at least one magnetic field at a rate from about 10 feet per minute to about 50 feet per minute. In addition, the at least one magnetizer bar can be configured or arranged to rotate for moving the at least one planar sheet through the at least one magnetic field at a rate of at about 15 feet/min. Further, the at least one sheet decoupler can comprise or consist of a plurality of decoupler elements. Even further, each of the plurality of decoupler elements can be spaced about every inch along the at least one longitudinal axis. Moreover, the at least one magnetizer bar can comprise or consist of about 10 to about 20 laminations per inch. Additionally, the at least one magnetizer bar can comprise or consist of exactly 12 laminations per inch.

The at least one magnetizer bar, for example, can comprise or consist of a magnetic field of about 5000 Gauss to about 6000 Gauss. Further, the at least one magnetizer bar can comprise or consist of exactly 16 laminations per inch. In addition, the at least one magnetizer bar can have a magnetic field of about 4000 Gauss to about 5000 Gauss.

The at least one positioner can comprise or consist of at least one user-adjustable planar sheet feeder structured and arranged to user-adjustably feed the at least one planar sheet into the at least one magnetizer. The at least one adjustable planar sheet feeder, for example, can accept a sheet width of less than about 13 inches. Moreover, the at least one adjustable planar sheet feeder can be configured to collapse to allow containment in the at least one enclosure when stored.

The at least one rotary movement generator can comprise or consist of at least one motor. Further, the at least one rotary movement generator can have at least one power cord configured or arranged to assist power transfer from at least one power source to the at least one rotary movement generator. For example, the at least one power cord can be contained in the at least one enclosure when stored.

The at least one enclosure can comprise or consist of at least one securable briefcase configured or arranged to provide briefcase securing of the at least one enclosure. The at least one hand-carrier comprises or consists of at least one handle.

The at least one mounting member can be configured or arranged to mount, in at least one operational alignment, the at least one positioner and the at least one magnetizer to the at least one enclosure. Further, the at least one mounting member can be configured or arranged to mount, in at least one operational alignment, the at least one positioner and the at least one magnetizer to the at least one enclosure. In addition, the at least one mounting member can comprise or consist of at least one aligning-mounting plate. The at least one aligning-mounting plate can mount to the at least one enclosure.

The at least one aligning-mounting plate can divide the at least one enclosure into at least one operation-isolated region configured or arranged to assist protection of the at least one magnetizer and the at least one rotary movement generator from external interaction during operation of such at least one magnetizer; and at least one operation-accessible region configured or arranged to permit user access during operation of the at least one magnetizer. The at least one enclosure can comprise or consist of at least one aperture configured or arranged to permit an operating power connection between the at least one rotary movement generator and the external power source.

The device or system for magnetizing at least one planar sheet of flexible magnetizable material can also comprise or consist of at least one magnetizer configured or arranged to provide at least one magnetic field source; at least one positioner structured and arranged to permit positioning of the at least one planar sheet into at least one magnetizing interaction relationship with the at least one magnetizer; at least one enclosure structured and arranged to enclose the at least one magnetizer and the at least one positioner; and at least one hand-carrier configured or arranged to permit hand-carrying of the at least one enclosure. Moreover, the at least one magnetizer can comprise or consist of at least one permanent magnet. Additionally, the at least one magnetizer can comprise or consist of at least one magnetizer bar having at least one longitudinal axis; the at least one magnetizer bar comprising or consisting of a plurality of discrete field-producing lamination-sets spaced along the at least one longitudinal axis; each discrete field-producing lamination-set can comprise or consist of at least one circular magnetic disk and at least one circular flux-conducting spacer magnetically coupled with the at least one circular magnetic disk; and each of the at least one circular magnetic disk and each of the at least one circular flux-conducting spacer can be coaxial with the at least one longitudinal axis. Also, the at least one axial-holder structured and arranged to axially-hold such at least one magnetizer bar along such at least one longitudinal axis.

The at least one rotary movement generator can be configured or arranged to generate rotary movement of the at least one axial-holder and the at least one magnetizer bar. The at least one magnetizer bar can be configured or arranged to magnetically couple to the at least one planar sheet, when the at least one planar sheet is in position to pass through the at least one magnetic field produced by the at least one magnetic field source, to transfer movement to the at least one planar sheet. The at least one magnetizer bar is configure or arranged to rotate to move the at least one planar sheet through the at least one magnetic field. The at least one planar sheet decoupler can be configured or arranged to decouple the at least one planar sheet from the at least one magnetizer bar during movement of the at least one planar sheet through at least one magnetic field. Moreover, when the at least one planer sheet is in position and coupled to the at least one magnetizer bar, the at least one magnetizer bar can be configured or arranged to rotate to move the at least one planar sheet through the at least one magnetic field at a rate from about 10 feet per minute to about 50 feet per minute. Additionally, when the at least one planer sheet is in position and coupled to the at least one magnetizer bar, the at least one magnetizer bar can be configured or arranged to rotate for moving the at least one planar sheet through the at least one magnetic field at a rate of at about 15 feet/min.

The at least one sheet decoupler can comprise or consist of a plurality of decoupler elements. The decoupler elements can be spaced about every inch along the at least one longitudinal axis. The at least one sheet decoupler can comprise or consist of at least one planar rigid decoupler plate. The at least one planar rigid decoupler plate can comprise or consist of a plurality of apertures configured or arranged to permit protrusion of at least one portion of the at least one magnetizer bar to assist movement of the at least one planar sheet, when the at least one planer sheet is in position and coupled to the at least one magnetizer bar. The at least one magnetizer bar can comprise or consist of at least one magnetizer bar set situate partially above and partially below a movement track of the at least one planar sheet. Moreover, the at least one magnetizer bar set can comprise or consist of at least two magnetizer bar sub-sets, each such magnetizer bar sub-set comprising or consisting of at least one magnetic field source located above the movement track; at least one magnetic field source located below the movement track; and at least one flux field situated between the at least one magnetic field source located above the movement track and the at least one magnetic field source located below the movement track so that at least one flux field crosses the movement track.

The device or system can comprise or consist of at least one magnetic field source aligner configured or arranged to align the at least one magnetic field source located above the movement track and the at least one magnetic field source located below the movement track in such manner as to maximize the at least one flux field crossing the movement track. Each upper magnetic field source can be encased to provide at least one smooth surface, and the encasing material allows for maximum transmission of the magnetic field. For example, the encasing material can be brass material.

The at least one magnetizer bar comprises or consists of at least one magnetizer bar set located below a movement track of the at least one planar sheet. Further, each discrete field-producing lamination-set can comprise or consist of about 10 to about 20 laminations per inch. Moreover, each discrete field-producing lamination-set, for example, can comprise or consist of exactly 12 laminations per inch. Additionally, each such discrete field-producing lamination-set, for example, can comprise or consist of a magnetic field of about 5000 Gauss to about 6000 Gauss. Also, each discrete field-producing lamination-set, for example, can comprise exactly 16 laminations per inch. In addition, each discrete field-producing lamination-set can comprise or consist of a magnetic field of about 4000 Gauss to about 5000 Gauss.

The at least one rotary movement generator can comprise or consist of at least one motor. Further, the at least one power cord can be configured or arranged to assist power transfer from the at least one external power source to the at least one rotary movement generator. The at least one power cord can be contained within the at least one enclosure when stored. Even further, the at least one mounting member can be configured or arranged to mount, in at least one operational alignment, the at least one positioner and the at least one magnetizer to the at least one enclosure. Moreover, the at least one mounting member can comprise or consist of at least one aligning-mounting plate. Additionally, the at least one aligning-mounting plate can comprise or consist of the at least one planar rigid decoupler plate. The at least one planar rigid decoupler plate can comprise or consist of a plurality of apertures configured or arranged to permit protrusion of at least one portion of the at least one magnetizer bar to assist movement of the at least one planar sheet.

The at least one aligning-mounting plate mounts to the at least one enclosure. The at least one aligning-mounting plate can divide the at least one enclosure into at least one operation-isolated region configured or arranged to assist protection of the at least one magnetizer and the at least one rotary movement generator from external interaction during operation of the at least one magnetizer; and at least one operation-accessible region configured or arranged to permit the user access during operation of the at least one magnetizer.

The at least one enclosure can comprise or consist of at least one aperture configured or arranged to permit operating power connection between the at least one rotary movement generator and the external power source. Even further, for example, the at least one enclosure can comprise or consist of at least one securable briefcase configured or arranged to provide briefcase securing of the at least one enclosure. Moreover, the at least one hand-carrier can comprise or consist of at least one handle. Additionally, the at least one mounting member can be configured or arranged to mount, in at least one operational alignment, the at least one positioner and the at least one magnetizer to the at least one enclosure. The at least one positioner can comprise or consist of at least one user-adjustable planar sheet feeder configured or arranged to user-adjustably feed the at least one planar sheet into the at least one magnetizer. In addition, the at least one adjustable planar sheet feeder, for example, can accept a sheet width of less than about 13 inches. The at least one adjustable planar sheet feeder can be configured or arranged to collapse to allow containment in the at least one enclosure when stored.

The device or system for magnetizing at least one substantially planar sheet of substantially flexible magnetizable material can comprise or consist of at least one first magnetic field source configure or arranged to produce at least one first magnetic field; at least one second magnetic field source configured or arranged to produce at least one second magnetic field; and at least one geometric positioner structured or arranged to geometrically position the at least one first magnetic field source and the at least one second magnetic field source to generate at least one first magnetic-flux field region resulting from at least one magnetic-field interaction between the at least one first magnetic field and the at least one second magnetic field. The at least one first magnetic-flux field region can be situated substantially between the at least one first magnetic field source and the at least one second magnetic field source. The at least one geometric positioned can comprise or consist of at least one passage configured or arranged to allow moving passage of the substantially flexible magnetizable material through the at least one first magnetic-flux field region; at least one enclosure configure or arranged to enclose the at least one first magnetic field source, the at least one second magnetic field source, and the at least one geometric positioner; and at least one hand-carrier configured or arranged to permit hand-carrying of the at least one enclosure.

The at least one second magnetic field source is configure or arranged to make physical contact with the at least one substantially planar sheet of substantially flexible magnetizable material during passage through such at least one first magnetic-flux field region. The at least one first magnetic field source can be configured or arranged to avoid physical contact with the at least one substantially planar sheet of substantially flexible magnetizable material during passage through such at least one first high-flux field region. Even further, each of the at least one first magnetic field source and the at least one second magnetic field source can comprise or consist of at least one magnetizer bar having at least one longitudinal axis. The at least one magnetizer bar can comprise or consist of a plurality of discrete field-producing lamination-sets spaced along the at least one longitudinal axis. Each discrete field-producing lamination-set can comprise or consist of at least one circular magnetic disk and at least one circular flux-conducting spacer magnetically coupled with the at least one circular magnetic disk. Each at least one circular magnetic disk and each at least one circular flux-conducting spacer can be coaxial having at least one longitudinal axis.

Moreover, the at least one axial-holder can be configured or arranged to axially-hold the at least one magnetizer bar along the at least one longitudinal axis. Additionally, the at least one rotary movement generator can be configured or arranged to generate rotary movement of the at least one axial-holder and the at least one magnetizer bar. Also, the at least one magnetizer bar can be configured or arranged to magnetically couple to the at least one planar sheet, when the at least one planar sheet is in position to pass through at least one magnetic field produced by the at least one magnetic field source, to transfer movement to the at least one planar sheet. In addition, when the at least one planer sheet is in position and coupled to the at least one magnetizer bar, the at least one magnetizer bar is structured and arranged to rotate for moving the at least one planar sheet through the at least one first magnetic-flux field region. The at least one planar sheet decoupler can be configured or arranged to decouple the at least one planar sheet from the at least one magnetizer bar during movement of the at least one planar sheet through the at least one first magnetic-flux field region. Further, the at least one magnetizer bar can be configured or arranged to rotate for moving the at least one planar sheet through the at least one first magnetic-flux field region at a rate from about 10 feet per minute to about 50 feet per minute. Even further, the at least one magnetizer bar rotates for moving the at least one planar sheet through the at least one first magnetic-flux field region at a rate of at about 15 feet/min.

Even further, the at least one magnetizer bar can comprise or consist of at least one magnetizing portion having from about 10 to about 20 laminations per inch. Even further, the at least one magnetizing portion, for example, can comprise or consist of exactly 16 laminations per inch. Even further, the at least one magnetizing portion, for example, can have a magnetic field of about 4000 Gauss to about 5000 Gauss. Even further, the at least one sheet decoupler can comprise or consist of at least one planar rigid decoupler plate. Even further, the at least one planar rigid decoupler plate can comprise or consist of a plurality of apertures structured and arranged to permit protrusion of at least one portion of the at least one magnetizer bar to assist movement of the at least one planar sheet. Even further, the at least one planar rigid decoupler plate can mount to the at least one enclosure.

The at least one planar rigid decoupler plate can divide the at least one enclosure into at least one operation-isolated region configured or arranged to assist protection of the at least one magnetizer and the at least one rotary movement generator from external interaction, during operation of the at least one magnetizer; and at least one operation-accessible region configured or arranged to permit user access during operation of the at least one magnetizer. Even further, the at least one user-adjustable planar sheet feeder can be configured or arranged to user-adjustably feed the at least one planar sheet through the at least one first magnetic-flux field region. Even further, the at least one adjustable planar sheet feeder, for example, can accept a sheet width of less than about 13 inches. In addition, the at least one adjustable planar sheet feeder can be configured to collapse to allow containment in the at least one enclosure when stored.

The at least one magnetic field source aligner can be configured or arranged to align the at least one first magnetic field source located above the movement track and the at least one second magnetic field source located below the movement track in such manner as to maximize the at least one magnetic-flux field region crossing the movement track. The at least one first magnetic field source is encased to provide at least one smooth surface. The encasing material allows maximum transmission of the magnetic field. For example, the encasing material comprises brass material.

A briefcase device and system for magnetizing of at least one planar sheet of flexible magnetizable material can comprise or consist of at least one briefcase, the at least one briefcase comprises or consists of at least one aperture providing access to an interior of the at least one briefcase even when the at least one briefcase is closed.

The device or system for magnetizing the at least one planar sheet of flexible magnetizable material comprises or consists of at least one magnetizer configured or arranged to magnetize the at least one planar sheet using at least one magnetic field source, and at least one briefcase-type enclosure configured or arranged to enclose the at least one magnetizer. The at least one briefcase-type enclosure can comprise or consist of at least one handle configured to assist single-hand carrying of the at least one briefcase-type enclosure enclosing the at least one magnetizer. The at least one planar sheet, when magnetized by such at least one magnetizer, is capable of magnetically adhering to at least one magnetically receptive material.

The at least one magnetizer can comprise or consist of at least one permanent magnet. Additionally, the at least one magnetizer can comprise or consist of at least one magnetizer bar having at least one longitudinal axis. The at least one magnetizer bar can comprise or consist of a plurality of discrete field-producing lamination-sets spaced along the at least one longitudinal axis. Each discrete field-producing lamination-set can comprise or consist of at least one circular magnetic disk and at least one circular flux-conducting spacer magnetically coupled with the at least one circular magnetic disk. Each at least one circular magnetic disk and each at least one circular flux-conducting spacer are coaxial with the at least one longitudinal axis.

The at least one rotary movement generator can be configured or arranged to generate rotary movement of the at least one magnetizer bar about the at least one longitudinal axis. In addition, the at least one magnetizer bar can be configured or arranged to magnetically couple to the at least one planar sheet, when the at least one planar sheet is in position to pass through at least one magnetic field produced by the at least one magnetic field source, to transfer movement to the at least one planar sheet. The at least one magnetizer bar can be configured or arranged to assist movement of the at least one planar sheet through the at least one magnetic field by the rotary movement of the at least one magnetizer bar about such at least one longitudinal axis.

The at least one magnetizer bar can comprise or consist of at least one magnetizer bar set located partially above and partially below a movement track of the at least one planar sheet. The at least one magnetizer bar set can comprise or consist of at least two magnetizer bar sub-sets. Each magnetizer bar sub-set can comprise or consist of at least one magnetic field source located above the movement track; at least one magnetic field source located below the movement track; and at least one flux field located between the at least one magnetic field source located above the movement track and the at least one magnetic field source located below the movement track, the at least one flux field crossing the movement track. The at least one magnetic field source located above the movement track can be encased to provide at least one smooth surface.

The at least one magnetizer bar can comprise or consist of at least one magnetizer bar set located below the movement track of the at least one planar sheet. The at least one rotary movement generator can comprise or consist of at least one electrical motor, and at least one power cord configured or arranged to assist power transfer from at least one external power source to the at least one electrical motor. The at least one power cord can be contained within the at least one briefcase-type enclosure when stored. The at least one positioned can be configured or arranged to permit positioning of the at least one planar sheet into at least one magnetizing interaction relationship with the at least one magnetizer. The at least one positioner can comprise or consist of at least one user-adjustable planar sheet feeder configured or arranged to user-adjustably feed the at least one planar sheet into the at least one magnetizer. The at least one adjustable planar sheet feeder, for example, can accept a sheet width of less than about 13 inches. The at least one adjustable planar sheet feeder can be configured to collapse to allow containment of the at least one enclosure when stored.

The at least one rotary movement generator can be configured or arranged to contact with the at least one magnetizer bar. The rotary movement generator can comprise or consist of at least one drive roller configured or arranged to generate rotary movement of the at least one magnetizer bar. The at least one drive roller can be operably coupled with the at least one motor. Moreover, the at least one drive roller can comprise or consist of at least one resilient contact surface configured or arranged to resiliently contact the at least one magnetizer bar during generation of the rotary movement. Additionally, the at least one magnetizer bar can comprise or consist of at least one magnetizer bar set located partially above and partially below the movement track of the at least one planar sheet. For example, the at least one magnetizer bar set can comprise or consist of at least two magnetizer bar sub-sets. Each magnetizer bar sub-set can comprises or consist of at least one magnetic field source located above the movement track, at least one magnetic field source located below the movement track, and at least one flux field located between the at least one magnetic field source located above the movement track and the at least one magnetic field source located below the movement track. The at least one flux field can be configure or arranged to cross the movement track.

The device or system for magnetizing at least one substantially planar sheet of substantially flexible magnetizable material can comprises or consist of at least one first magnetic field source configured and arranged to produce at least one first magnetic field; at least one second magnetic field source structured and arranged to produce at least one second magnetic field, and at least one geometric positioner configured or arranged to geometrically position the at least one first magnetic field source and the at least one second magnetic field source to generate at least one first magnetic-flux field region resulting from at least one magnetic-field interaction between the at least one first magnetic field and the at least one second magnetic field. The at least one geometric positioner can comprise or consist of at least one passage configured or arranged to allow moving passage of the substantially flexible magnetizable material through the at least one first magnetic-flux field region. The at least one user-adjustable planar sheet feeder can be configured or arranged to user-adjustably feed the at least one planar sheet through the at least one first magnetic-flux field region. The at least one sheet mover can be configured or arranged to assist movement of the at least one planar sheet through such at least one first magnetic-flux field region. The at least one enclosure can be configured or arranged to enclose the at least one first magnetic field source, the at least one second magnetic field source, and the at least one geometric positioned. The at least one hand-carrier can be configured or arranged to assist single-hand carrying of the at least one enclosure. The at least one planar sheet can be at least partially magnetized by passage through the at least one first magnetic-flux field region. The at least one user-adjustable planar sheet feeder can be configured or arranged to be collapsible to permit closure of the at least one enclosure.

The at least one first magnetic field source and the at least one second magnetic field source can comprise or consist of at least one magnetizer bar having at least one longitudinal axis. The at least one magnetizer bar can comprise or consist of a plurality of discrete field-producing lamination-sets spaced along the at least one longitudinal axis. Each discrete field-producing lamination-set can comprise or consist of at least one circular magnetic disk and at least one circular flux-conducting spacer magnetically coupled with such at least one circular magnetic disk. Each at least one circular magnetic disk and each at least one circular flux-conducting spacer can be coaxial with the at least one longitudinal axis. The at least one sheet mover can comprise or consist of at least one rotary movement generator configured or arranged to generate rotary movement of the at least one magnetizer bar. The at least one magnetizer bar can be configured or arranged to magnetically couple to the at least one planar sheet, when the at least one planar sheet is in position to pass through the at least one first magnetic-flux field region, to transfer movement to the at least one planar sheet.

The device or system for magnetizing at least one sheet of magnetizable material can comprise or consist of a magnetizer for magnetizing the at least one planar sheet using at least one magnetic field source, and an enclosure for enclosing the at least one magnetizer. The enclosure can comprise or consist of a hand-carrier for assisting hand-carrying with one hand. The at least one planar sheet, when magnetized by the magnetizer is then capable of magnetically adhering to at least one magnetically receptive material.

In accordance to this specification, the disclose subject matter includes each and every novel feature, element, combination, step and/or method disclosed or suggested by this patent application.

DETAILED DESCRIPTION

The magnetizable sheets can comprise a printable surface that allows them to be printed on by standard printers. These magnetizable sheets can cause problems with printers when they are run through the printer after magnetization, since a magnetic field may interfere with the operability of the printer. One solution to this problem is to print on the printable side of the magnetizable sheets prior to magnetization. The sheets would then not interfere with printer function, and after printing, the sheet may then be run through a magnetizer.

Figure 1:
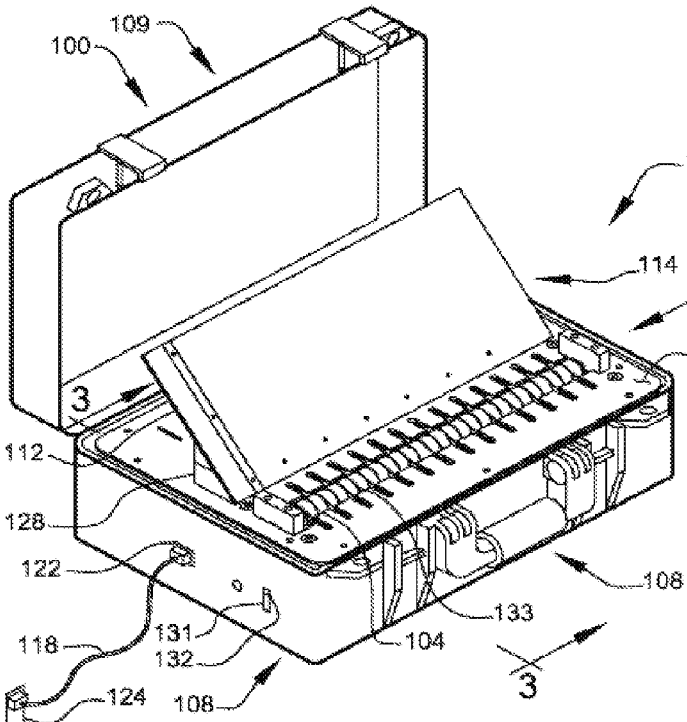
FIG. 1 is a perspective view of a portable magnetizer device and system in an operable configuration.

A portable magnetizer device 100 in an operable configuration 109 is shown in FIG. 1. The portable magnetizer device 100 provides a solution to the above stated problem of portable onsite magnetizing.

The portable magnetizer device 100 comprises at least one portable magnetizer 105. The portable magnetizer 105 comprises at least one briefcase enclosure 108. Other enclosures, such as, for example, box enclosures, top carry enclosures, soft case enclosures, may provide alternatives to the briefcase enclosure 108.

The portable magnetizer 105 comprises at least one magnetizer 101 housed inside the briefcase enclosure 108. The word "enclosure" means an enclosing device configured or arranged for enclosing the portable magnetizer 105 and the positioned (i.e. positioning geometry). The magnetizer 101 comprises at least one magnetic roller 133 and at least one feed tray 112 mounted to at least one panel 106, as shown in FIGS. 10 thru 17. The word "magnetizer" means a magnetizing device configured or arranged for providing at least one magnetic field source.

The magnetic roller 133 comprises at least one magnetizer array 104. Other magnetizing arrangements, for example, rollers with separate magnetizer arrays, magnetic bars arrays, dual magnetic field sources, etc. may provide an alternative to the magnetic roller 133.

Figure 3:
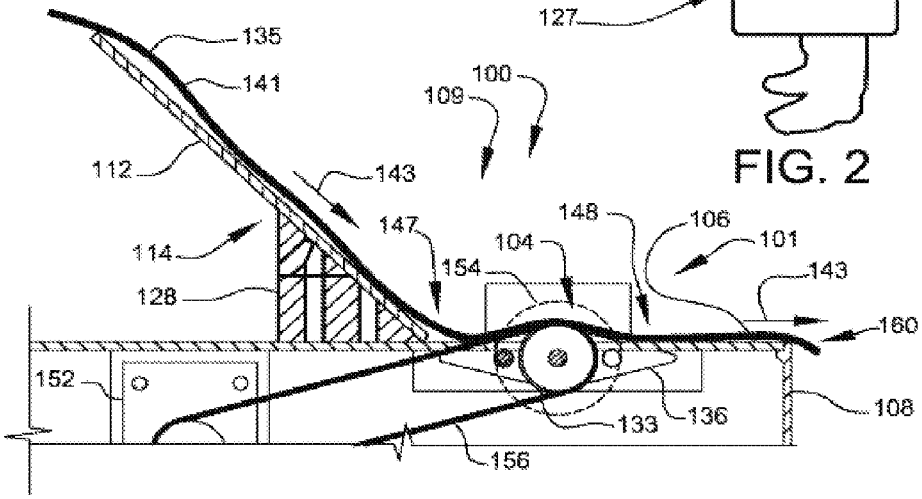
FIG. 3 is a partial cross-sectional view through the section 3-3 of FIG. 1, illustrating the flexible magnetizable sheet in transit adjacent to a magnetic roller.

In the operable configuration 109, the briefcase enclosure 108 is in an open position, as shown in FIGS. 1 and 3. The feed tray 112 is in an angled position 114. A power cord 118 (FIG. 1) is plugged into a power cord electrical receptacle 122 within portable magnetizer 105 at one end, and plug into the wall electrical outlet 124 at the opposite end. The power cord 118 is configured and arranged to transfer power from the power source (e.g. power cord electrical receptacle 122) to the portable magnetizer 105 (e.g. to supply power to the at least one rotary movement generator). Other power sources, for example, solar power cells, batteries, vehicle electrical circuits can provide an alternative to the power cord electrical receptacle 122.

Figure 5:
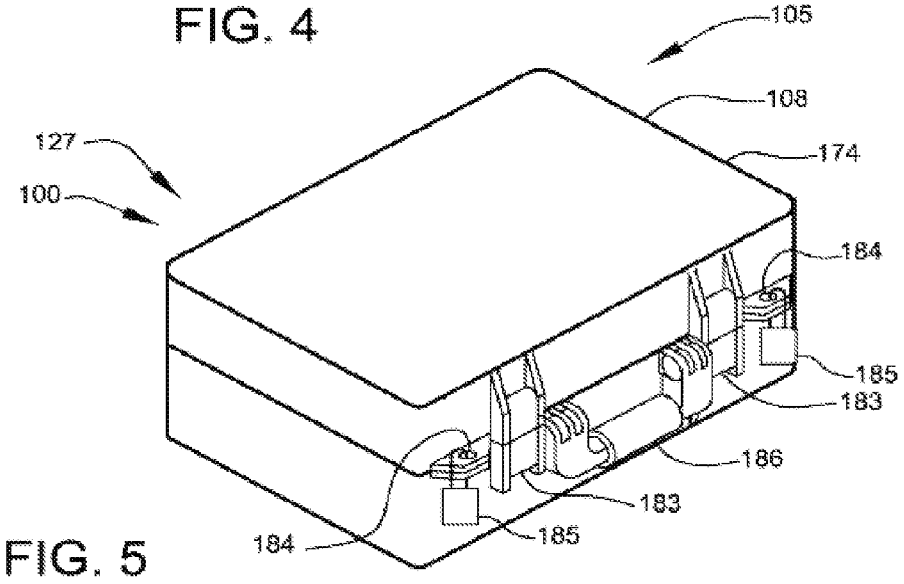
FIG. 5 is a perspective view illustrating the briefcase enclosure shown in FIG. 4 in a stowed configuration.

The portable magnetizer 105 is configured or arranged to be carried by a user 129. The portable magnetizer 105 can be closed and placed in a stowed configuration 127 when not in use, as shown in FIG. 5. The stowed configuration 127 of the portable magnetizer 105 assists the user 129 in carrying the portable magnetizer 105. For example, the portable magnetizer 105 can be made to weigh about 25 lbs.

The portable magnetizer 105 can be deployed by user 129 to the operable configuration 109 prior to use. First, briefcase enclosure 108 is opened, as shown in FIG. 1. Then, the feed tray 112 is deployed to angled position 114 by using at least one tray mount 128, as discussed in detail with reference to FIGS. 14-17. After plugging in the power cord 118 into the power cord electrical receptacle 124, the power switch 131 is then placed in the "on" position 132. Turning the power switch 131 to the "on" position 132 activates rotation of the magnetic roller 133.

The portable magnetizer 105 utilizes standard electrical power (e.g. about 115 volts alternating current at about 1.6 amperes of current load).

The flexible magnetizable sheet 141 is shown in transit adjacent to magnetic roller 133, as shown in FIG. 3. The flexible magnetizable sheet 141 can be loaded into the feed tray 112. The flexible magnetizable sheet 141 can be loaded with the printed side 135 facing away from feed tray 112. The term "positioning geometry" means the positioning the flexible magnetizable sheet 141 in at least one magnetizing interaction relationship with the at least one magnetizer.

The magnetic roller 133 pulls, through rotation and magnetic coupling, the flexible magnetizable sheet 141 from the feed tray 112. Specifically, the at least one magnetizer bar magnetically couples to the flexible magnetizable sheet 141 to transfer movement to the flexible magnetizable sheet 141. The magnetic roller 133 then drives, through rotation and magnetic coupling, the flexible magnetizable sheet 141 along the feed path 143, as shown in FIG. 3. For example, the magnetic roller 133 runs between about 10 feet/min and about 50 feet/min, or about 15 feet/min.

The magnetizer array 104, for example, can have a length of about 13 inches for allowing portable magnetizer 105 to magnetize the flexible magnetizable sheet 141 having a width less than about 13 inches. Further, the at least one adjustable planar sheet feeder accepts a width of the flexible magnetizable sheet 141 having the width less than about 13 inches. Other magnetizer array lengths, for example, 24 inches, 10 inches, 10 cm can provide an alternative to the width of 13 inches.

The magnetizer array 104 comprises a stripper plate 136. The stripper plates 136 in magnetizer array 104 guide the flexible magnetizable sheet 141 over the magnetic roller 133. The stripper plates 136 are shaped to allow flexible magnetizable sheet 141 to be guided on the entry side 147 and guided off the exit side 148 of the magnetic roller 133.

The magnetic roller 133 couples with and moves the flexible magnetizable sheet 141 over the magnetizer array 104 by magnetic coupling and rotating. The motor 152 and chain drive 156 provide rotary movement of the magnetic roller 133. In the process of passing over the magnetizer array 104, the flexible magnetizable sheet 141 is magnetized by the magnetic field 154 from the magnetic roller 133. The magnetic roller 133 components will be discussed in more detail in FIGS. 6 thru 9.

The flexible magnetizable sheet 141 is preferably moved along feed path 143 to the exit side 148 of the magnetic roller 133 guided by the stripper plates 136. The stripper plates 136 act as decouplers configure or arranged to decouple the flexible magnetizable sheet 141 from the magnetizer array 104 during movement of the flexible magnetizable sheet 141 through the magnetizer. Specifically, the stripper plates 136 de-couple the flexible magnetizable sheet 141 from the magnetic roller 133 during operation. The flexible magnetizable sheet 141 moves from the exit side 148 of the magnetic roller 133 to the panel 106. The flexible magnetizable sheet 141 then moves off the edge 160 of the briefcase enclosure 108. Other magnetic field generator arrangements, for example, solenoids, Helmholtz coils, bar magnets, iron core solenoids, electromagnets, or other magnetic generator technologies, etc. can provide an alternative to the magnetizer array 104.

Figure 4:
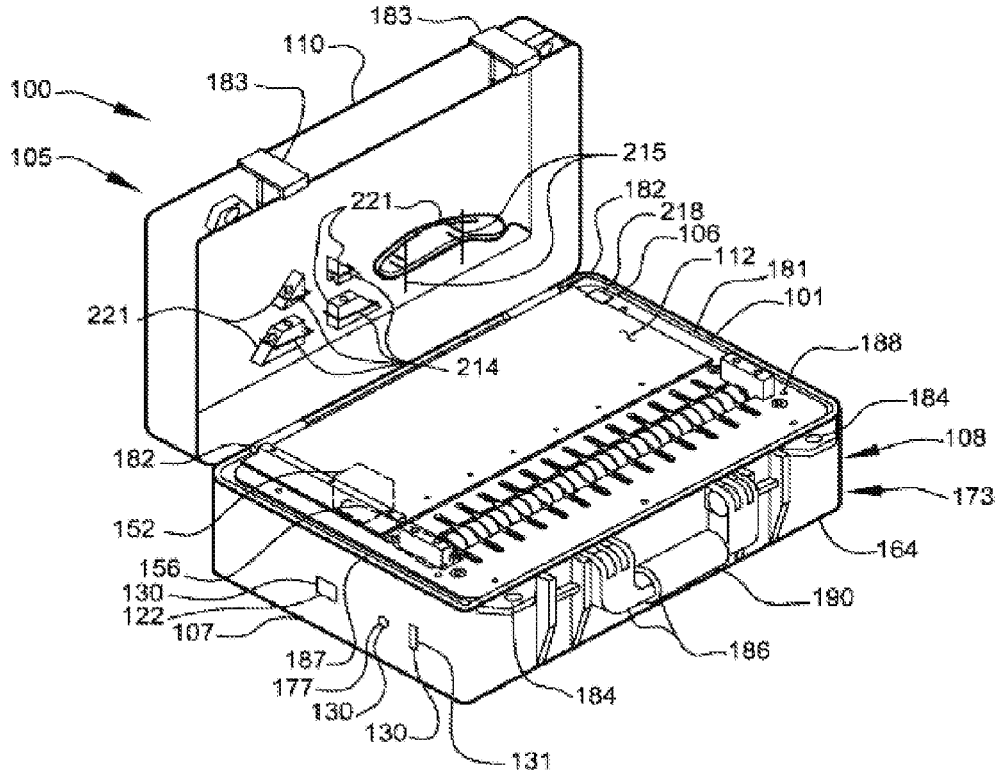
FIG. 4 is a perspective view, illustrating a briefcase enclosure in an open position with loose items and a feed tray secured therein.

The briefcase enclosure 108 in an open position 110 is shown in FIG. 4. The loose items 221 and feed tray 112 are secured in the enclosure 108. The briefcase enclosure 108 , for example, can be a Pelican model 1500 case 107. The Pelican model 1500 case 107 is available from Pelican Products, Inc., 23215 Early Avenue, Torrance, Calif. 90505 (Tel. 310-326-4700) or from www.pelican.com on the Internet. The briefcase enclosure 108 comprises a seal 181, a hinge 182, latches 183, padlock holes 184, and a handle 186, as shown in FIG. 4. The briefcase enclosure 108 can be configured or arranged to permit hand carrying of the briefcase enclosure 108, and can embody at least one hand-carrier feature configured or arranged to permit hand carrying of the briefcase enclosure 108.

The seal 181, for example, can be an O-ring seal positioned along the perimeter of the briefcase enclosure 108. The latches 183, for example, are double throw latches. The padlock holes 184, for example, are reinforced padlock holes such as a stainless steel reinforced padlock holes. The handle 186, for example, is a molded handle. The handle 186 can optionally comprise or consist of rubber padding 190.

The briefcase enclosure 108 comprises a continuous panel flange 187 having pre-drilled holes 188 to receive and mount the panel 106. The panel 106 mounts to the panel flange 187, and comprises the magnetizer array 104, feed tray 112, and motor 152. The briefcase enclosure 108 comprises accessory openings 130. The briefcase enclosure 108 can comprise at least one aperture providing access to an interior of the briefcase enclosure 108 even when the briefcase enclosure 108 is closed. For example, the briefcase enclosure 108 comprises an aperture 130 configured or arranged to receive an operating power connection 130 between the rotary movement generator and the external power source, another aperture 130 configured or arranged to receive the power switch 131, a further aperture 130 power cord receptacle 122 configured or arranged to receive the fuse 177.

The briefcase enclosure 108 can serve several functions as a portable magnetizer 105. The briefcase enclosure 108 houses the magnetizer 101, the motor 152 and chain drive 156, as shown in FIG. 3. For example, the briefcase enclosure is configured or arranged to keep the motor 152 and chain drive 156 contained as well as guarded for safety during operation. The panel 106 and the lower portion 173 (FIG. 4) of briefcase enclosure 108 can make up one housing 164. Specifically, the lower portion 173 can provide one operation-isolated region configured or arranged to assist protection of the magnetizer and the rotary movement generator from external interaction, during operation of the magnetizer. The motor 152 and chain drive 156 are contained while the portable magnetizer device is in the operable configuration 109 (FIG. 1), or in the stowed configuration 127 (FIG. 5).

Another function of the briefcase enclosure 108 is to secure loose items 221. The loose items 221, for example, are items located within portable magnetizer device 100, which when not secured, could damage the magnetizer 101 during movement or relocation of the portable magnetizer device 100. The loose items 221, for example, can include the tray mounts 128 and the power cord 118. The loose items 221 can be secured by the user 129 (FIG. 2) when configuring the briefcase enclosure 108 to the stowed configuration 127 (FIG. 5). In the stowed configuration 127, the tray mounts 128, power cord 118, and feed tray 112 (FIG. 3) can be secured therein. The feed tray 112 can be configured or arranged to be collapsed to the closed position shown in FIG. 4 when being stored or transported. Specifically, the feed tray 112 collapses to allow containment thereof within the briefcase enclosure 108 when being stored.

The briefcase enclosure 108 comprises a storage mount 214 (FIG. 4) for tray mounts 128 (FIG. 3), and a storage mount 215 for power cord 118. Additionally, the feed tray 112 is secured with a lock down mechanism 218 to prevent movement of the feed tray 112 while in the stowed configuration 127. Again, the securing of the loose items 221 prevents damage to the magnetizer 101. Other loose items 221, for example, cord retractors, collapsible tray mounts, spring locks, molded forms, molded foams can be stored within the briefcase enclosure 108

Figure 2:
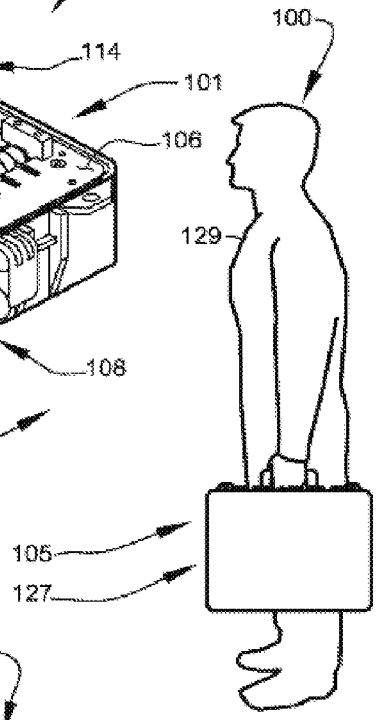
FIG. 2 is a side view, illustrating the portable magnetizer shown in FIG. 1 being carried by a user.

The briefcase enclosure 108 is in the stowed configuration 127, as shown in FIG. 5. Another function of briefcase enclosure 108 is to make the portable magnetizer 105 portable, secure, and easily storable. The portable magnetizer 105 becomes portable, secure, and easily storable when transitioned to the stowed configuration 127. When the user 129 is ready to transition the briefcase enclosure 108 to the stowed configuration 127, the loose items 221 are first secured (FIG. 4). The briefcase lid 174 is then closed and latched with the latches 183. The padlocks 185 are inserted into the padlock holes 184 and locked. The user 129 then can carry the briefcase enclosure 108 by grasping the handle 186, as shown in FIG. 2. This arrangement provides a securable briefcase enclosure 109 for providing briefcase securing of the briefcase enclosure 109.

The stowed configuration 127 of the briefcase enclosure 108 reduces the size of the portable magnetizer device 10 making it smaller for storage. The stowed configuration 127 of briefcase enclosure 108 also allows for simplified handling and moving of the portable magnetizer device100 by configuring the portable magnetizer device100 into a manageable size that can be easily held by the handle 186. In addition, the padlocks 185 add security to the portable magnetizer device100 by controlling access to briefcase enclosure 108. Other enclosure arrangements, for example, custom case designs, OEM preconfigured briefcases, or cases made of alternate materials (such as steel, aluminum, wood, or wireframe) can provide an alternative to the briefcase enclosure 108.

Figure 6:
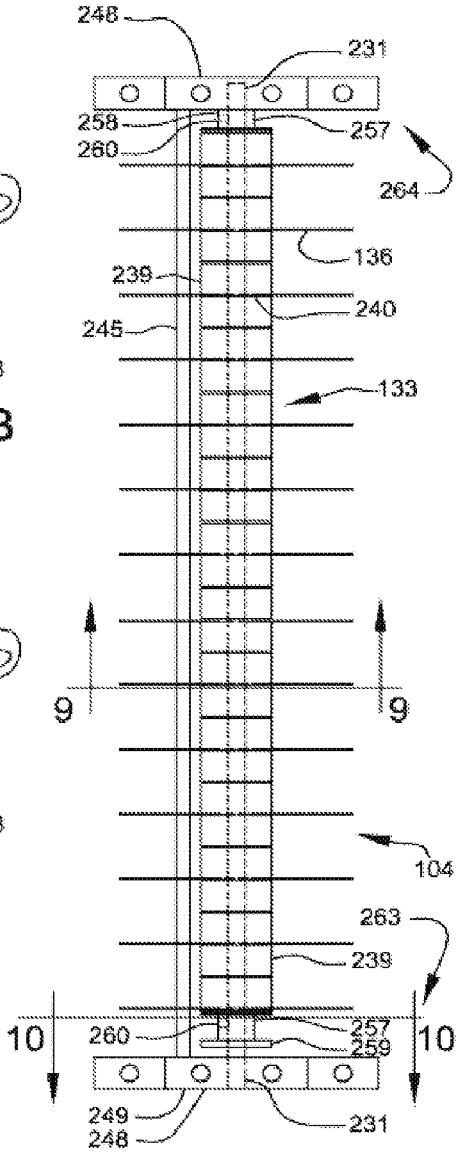
FIG. 6 is a top view, illustrating at least one magnetizer array with array mounts of the portable magnetizer device and system shown in FIG. 1.

The magnetizer array 104 with array mounts 248 is shown in FIG. 6. The magnetizer 101(FIG. 1) comprises the magnetizer array 104. The magnetizer array 104 comprises a magnetic roller 133. The magnetic roller 133, for example, can have a one-inch (1") diameter. The magnetic roller 133 comprises at least one magnetic stack 239, or a plurality of magnetic stacks 239.

The magnetic roller 133 comprises a shaft 231. Shaft 231 preferably rotates magnetic stacks 239 of magnetic roller 133, during operation. The shaft 231 together with the magnetic stacks 239 of the magnetic roller 133 are rotated by motor 152 via the chain drive 156. Other rotary movement generator can be used to rotate the magnetic roller 133 as an alternative to the motor 152 and chain drive 156.

The rotation of the magnetic roller 133 moves the flexible magnetizable sheet 141 over the magnetizer array 104. The magnetic field 154 of the magnetic roller 133 induces a magnetic field and magnetic alignment in the flexible magnetizable sheet 141 as it passes over the magnetic roller 133. The flexible magnetic sheet 141 retains at least a portion of this magnetic alignment and thereby becomes magnetized.

The stripper plates 136, for example, can be spaced about 1-inch (1") apart along the shaft 231 between the magnetic stacks 239. The magnetic roller 133 comprises a set of discrete field-producing laminations spaced substantially along the longitudinal axis thereof. The stripper plates 136 provide a sheet decoupler for the flexible magnetizable sheet 141.

The magnetizer array 104 comprises a stabilizer bar 245 (FIG. 6) that runs between the array mounts 248. The stabilizer bar 245 stabilizes the stripper plates 136, and prevents rotation of the stripper plates 136 during operation. Further, the stabilizer bar 245 positions the stripper plates 136 to optimize operation of the magnetizer 101.

Figure 7A:
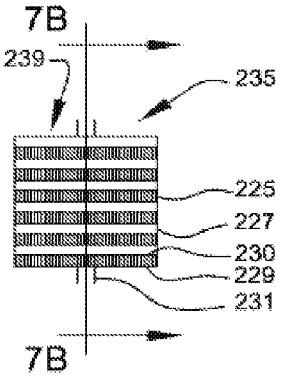
FIG. 7A is an enlarged top view, illustrating a magnetic stack of the at least one magnetizer array shown in FIG. 6.

A magnetic stack 239 is shown in FIG. 7A. The magnetic stack 239 comprises a plurality of spaced apart disk magnets 225 providing one or more magnetic field sources (e.g. permanent magnet). Steel washers 227 a provided between adjacent disk magnets 225 to space same apart. The disk magnets 225 and steel washers 227 are provided along shaft 231. This arrangement provides at least one axial-holder means for axially-holding the magnetizer along a single longitudinal axis. The at least one axial-holder can be configured or arranged to axially-hold the at least one magnetizer bar (e.g. magnetic roller 133) along the at least one longitudinal axis. The at least one magnetic field source comprises at least one magnetizer bar (e.g. magnetic roller 133) having at least one longitudinal axis. This arrangement provides a discrete field-producing lamination of the set comprising at least one substantially circular magnetic disk magnetically coupled with at least one substantially circular flux-conducting spacer.

The disk magnets 225 are arranged with all like poles facing in the same direction so as to alternate positive poles 229 and negative poles 230 along the magnetic stack 239. Other magnet arrangements, for example, segmented disk magnets, mono-pole magnets, intrinsically layered magnets can provide an alternative to the magnetic stack 239.

The magnetic stack 239, for example, can have a diameter of about 1-inch (1"). The magnetic stack 239, for example, can having a length of about 1-inch (1"). Other dimensions, such as, for example, 2 inches, 1 foot, 5 cm can be suitable for particular applications.

Figure 7B:
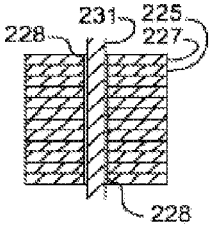
FIG. 7B is a cross-sectional view through the section 7B-7B of FIG. 7A, illustrating a 12-PPI stack set on a shaft.

The magnetic stack 239, for example, comprises a 12-PPI (poles per inch) stack 235 (herein sometimes referred to as PPI stack). The 12-PPI stack 235 is mounted on the shaft 231. The 12-PPI stack 235 comprises 12 disk magnets 225 and 12 steel washers 227 per inch. This arrangement provides at least one magnetizer bar comprising exactly 12 discrete field-producing laminations per inch. The 12-PPI stack 235, for example, comprises a magnetic field between about 5000 gauss and 6000 Gauss. A sectional view through the section 7B-7B of FIG. 7A, is shown in FIG. 7B. The 12-PPI stack 235 is mounted on shaft 231. The disk magnets 225 and steel washers 227 have at least one center hole 228 permitting placement over the shaft 231.

Figure 8A:
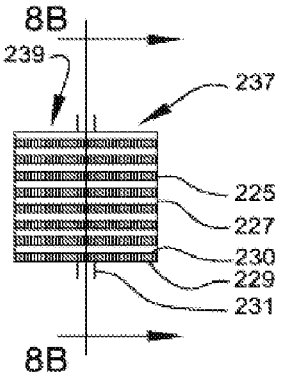
FIG. 8A is an enlarged top view, illustrating an alternative magnetic stack of the at least one magnetizer array shown in FIG. 6.
Figure 8B:
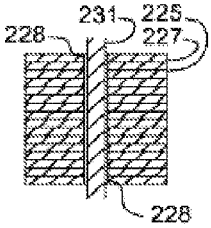
FIG. 8B is a cross-sectional view through the section 8B-8B of FIG. 8A, illustrating a 16-PPI stack set on a shaft.

An alternative magnetic stack 239 is shown in FIGS. 8A and 8B. The alternative magnetic stack 239 is a 16-PPI stack 237 set on a shaft 231. For example, the 16-PPI stack 237 comprises 16 disk magnets 225 and 16 steel washers 227 per inch. This arrangement of the at least one magnetizer bar (magnetic roller) comprises exactly 16 discrete field-producing laminations per inch. The 16-PPI stack 237 comprises a magnetic field, for example, between about 4000 Gauss and about 5000 Gauss.

Figure 9:
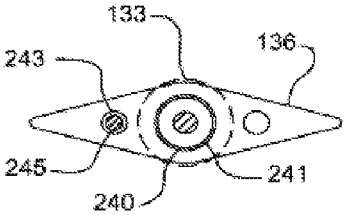
FIG. 9 is a sectional view through the section 9-9 of FIG. 6, illustrating a stripper plate with a small-diameter washer, shaft, and a stabilizer bar.

The stripper plate 136 along with a small-diameter washer 241, shaft 231, and at least one stabilizer bar 245 is shown in FIG. 9. The stripper plates 136 comprise a center hole 240 to accommodate the small-diameter washer 241. The small-diameter washer 241 fits on the shaft 231 inside the center hole 240 of the stripper plates 136. The small-diameter washer 241, for example, can be made of steel and provides spacing clearance between rotating portions of the magnetic roller 133 and stripper plates 136. The small-diameter washer 241 spaces the stripper plate from shaft 231 and isolates the stripper plates 136 from rotation of the shaft 231. In addition, the small-diameter washer 241 can be slightly thicker than stripper plate 136 to space stripper plate 136 away from magnetic stack 239 on either side. The stripper plates 136 do not rotate during operation of magnetizer 101.

Figure 10:
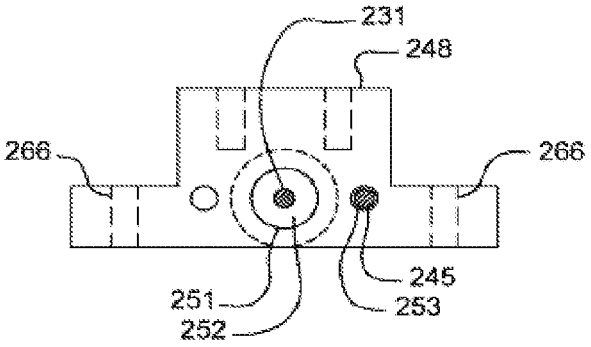
FIG. 10 is a sectional view through the section 10-10 of FIG. 6, illustrating at least one array mount.

The stabilizer bar 245 runs through at least one stabilizer-bar hole 243 in the stripper plates 136. The stabilizer bar 245 connects to the array mount 248 at each end of magnetizer array 104 (FIG. 6). Specifically, each end of the stabilizer bar 245 is received within the stabilizer-bar mounting holes 253 (FIG. 10).

The stabilizer bar 245 along with the small-diameter washer 241, prevent the stripper plates 136 from rotating. The stripper plates 136 are held by the stabilizer bar 245 against counter rotation of the shaft 231 and magnetic roller 133 during operation of magnetizer 101. The stripper plates 136 are stabilized by stabilizer bar 245 allowing the stripper plates 136 to guide the flexible magnetizable sheet 141 over the magnetic roller 133 (FIG. 3).

End plates 257 are mounted on both ends of the shaft 231 to hold the magnetic stacks 239, stripper plates 136, and small-diameter washers 241 on the shaft 231, as shown in FIG. 6. The end plates 257 comprise en end plate locking screw 260. The endplate locking screw 260 secures the endplates 257 to the shaft 231. The endplates 257 apply pressure to transfer rotation of the shaft 231 to the magnetic stacks 239 and small-diameter washers 241. Other rotation transfer devices, for example, key shafts, locking screws, adhesives can provide an alternative to the arrangement shown.

A gear-drive end plate 259 is located on the shaft 231 located at the motor side 263 (FIG. 6) of the magnetizer array 104. The gear-drive endplate 259 provides for the connection of the shaft 231 to the chain drive 156 and motor 152, to be discussed in detail below with reference to FIGS. 18-19. An end plate 257 is also located on shaft 231 at the non-motor side 264 of the magnetizer array 104. Other magnetizer holding arrangements, for example, non circular shafts, cable shafts, or non-shaft magnetizer can provide an alternative to the arrangement shown.

Each array mount 248 comprises a shaft hole 251, as shown in FIG. 10. The low-friction bearing 252 is mounted into the shaft hole 251, for example, by tight friction fit. The shaft 231 of the magnetic roller 133 of the magnetizer array 104, is mounted within the low friction bearing 252. Other rotating shaft mountings, such as, for example, rotating end-plates, coaxial bearings, lubricated joints can provide an alternative to the arrangement shown.

The array mount 248 comprises threaded holes 266. The threaded holes 266 receive array mount bolts 267, as shown best in FIGS. 11-13, to secure the array mount 248 to the panel 106. Other fasteners, such as, for example, rivets, pins, adhesives can provide an alternative to the arrangement shown.

Each array mount 248 comprises the stabilizer-bar mounting holes 253. The stabilizer-bar mounting hole 253 accepts the end of the stabilizer bar 245. Other stabilizer bar mountings, such as, for example, end bolts, adhesives, brackets can provide an alternative to the arrangement shown.

With reference to FIG. 10, the array mounts 248 supports the ends of the shaft 231 of the magnetizer array 104. The low friction bearings 252 allow the magnetic roller 133 to rotate freely between the array mounts 248.

Figure 11:
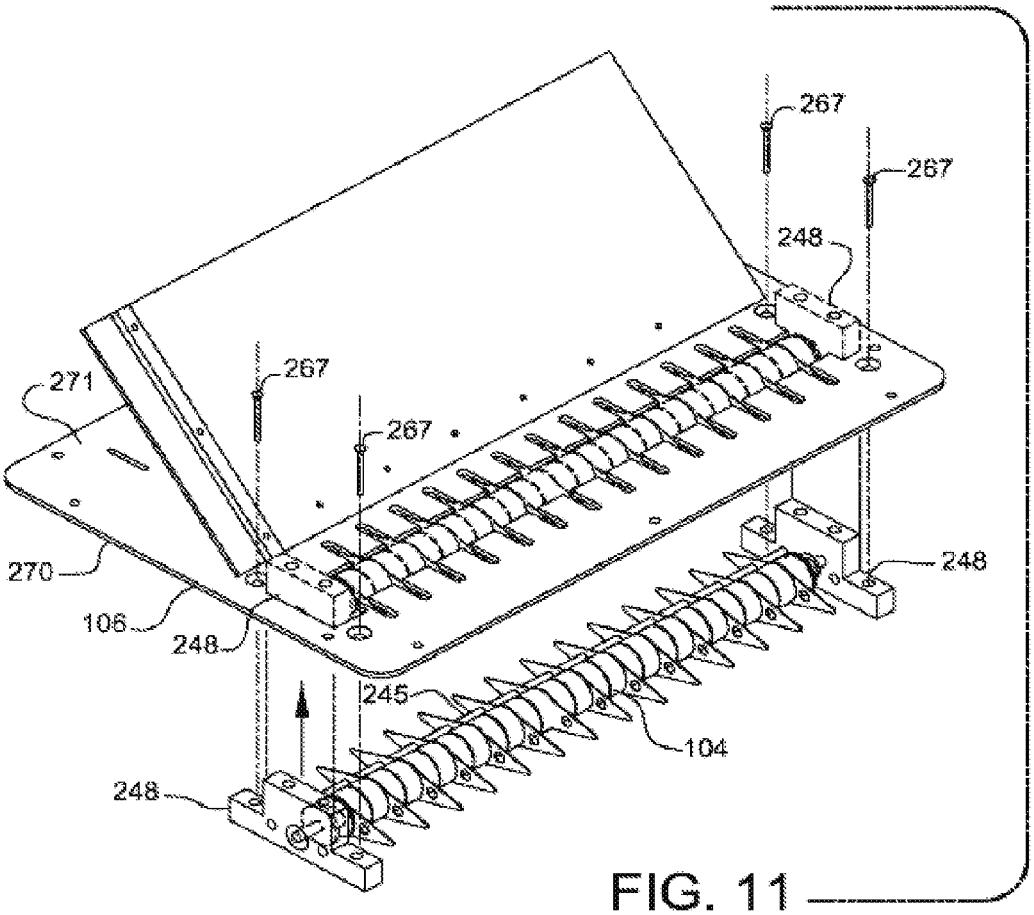
FIG. 11 is a perspective view, illustrating at least one magnetizer array assembly, including the magnetizer array shown in FIG. 6 and a panel.
Figure 12:
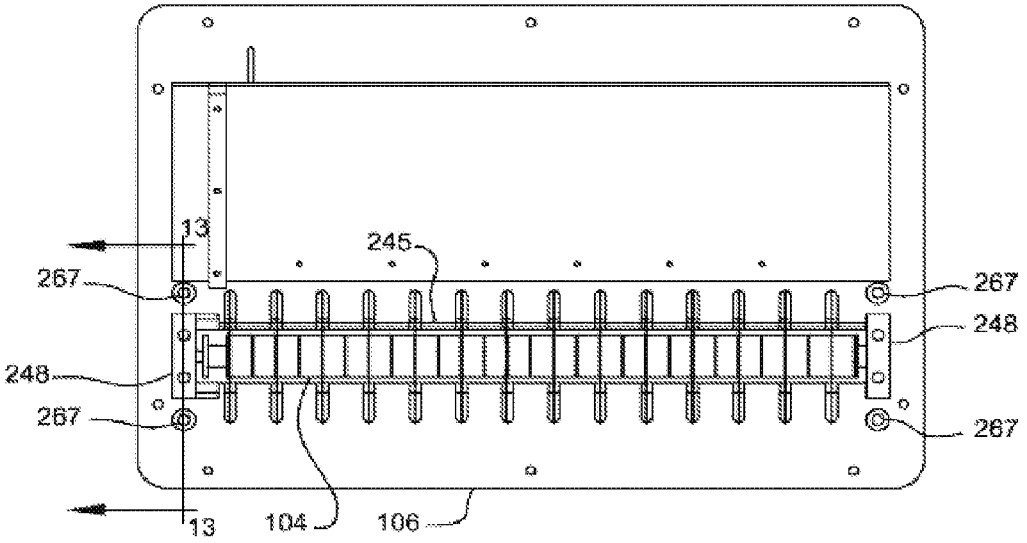
FIG. 12 is a top view, illustrating the at least one magnetizer array assembly with the magnetizer array attached to the panel shown in FIG. 11.
Figure 13:
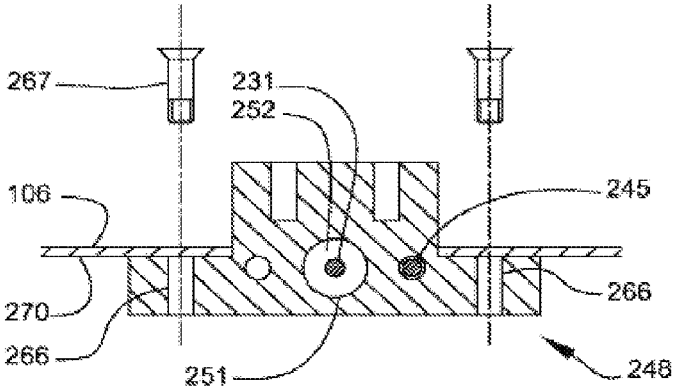
FIG. 13 is a partial sectional view through the section 13-13 of FIG. 12, illustrating the at least one array mount attached to the panel, according to the at least one magnetizer array shown in FIG. 12.

The magnetizer array assembly 205 comprises a magnetizer array 104 attached to an underside 270 of the panel 106 by the array mounts 248, as shown in FIG. 11. The array mounts 248, along with magnetizer array 104, are joined to the underside 270 of the panel 106. For example, the array mounts 248 are bolted to panel 106. This arrangement provides at least one mounting member configured or arranged to mount, in operational alignment the at least one positioner and the at least one magnetizer. FIG. 12 shows the magnetizer array 104 attached to the panel 106. FIG. 13 shows the array mount 248 attachment to the panel 106.

The array mounts 248 hold the magnetizer array 104 to the panel 106. The mounting of the magnetizer array 104 to panel 106 stabilizes the gear-drive end plate 259 (FIG. 6). The gear drive-end plate 259 is driven by chain drive 156 and motor 152 (FIG. 19) to rotate the magnetic roller 133. The array mounts 248 also hold the magnetizer array 104 in alignment with the feed tray 112. Other shaft holding arrangements, for example, mounting array mounts to top of panel (instead of bottom location of panel as indicated in this specification), array mounts molded in to panel, direct mounting of magnetizer to panel, or mounting magnetizer directly to portable briefcase enclosure can provide alternative to the arrangement shown.

Figure 14:
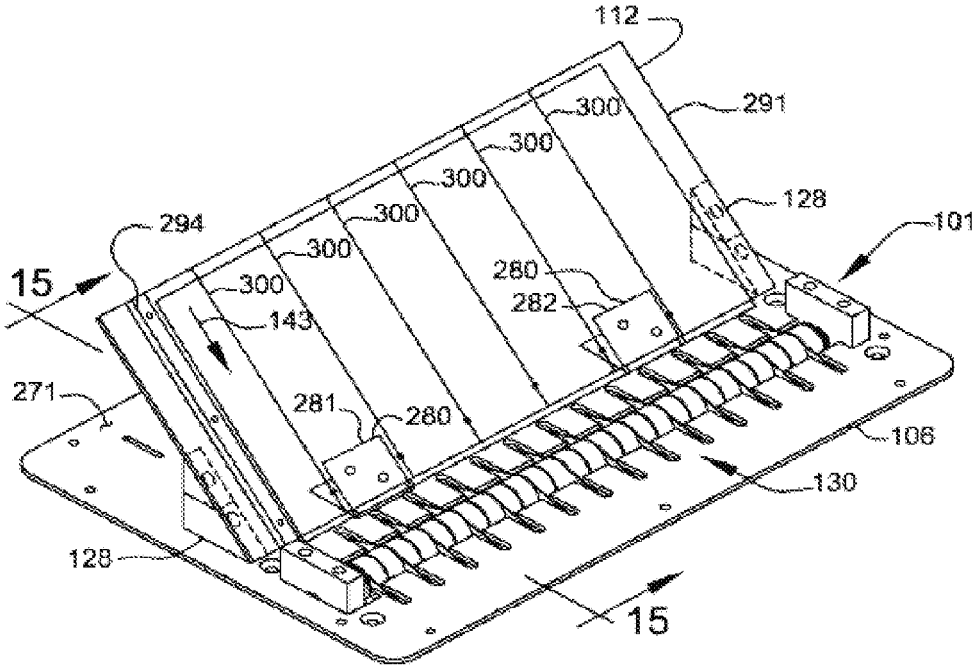
FIG. 14 is a perspective view, illustrating a feed tray mounted to the panel of the at least one magnetizer array assembly shown in FIG. 12.

FIG. 14 shows the feed tray 112 mounted to the panel 106 (FIG. 13). The feed tray 112 comprises at least one feed-tray panel 291, for example, made of steel material. The feed tray 112 further comprises an adjustable guide 294, for example, also made of steel material. Other materials, such as, for example, wood, plastics, other metals can provide an alternative to the steel material.

Figure 17:
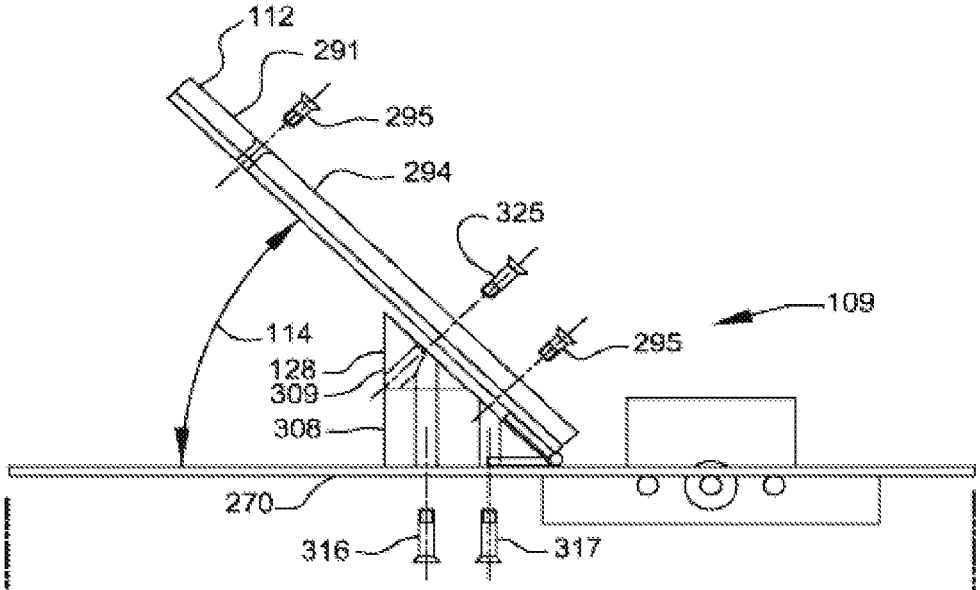
FIG. 17 is a side elevational view of the magnetizer array assembly, illustrating the feed tray and tray mounts shown in FIG. 16, deployed to an operable position.

The adjustable guide 294 is attached to the feed-tray panel 291 with counter-sink screws 295 (FIG. 17). The adjustable guide 294 can be mounted on the feed tray 112 at one of the variable positions 300 to assist feeding the flexible magnetizable sheet 141 straight across the magnetic roller 133. This arrangement provides at least one positioning geometry comprising at least one user-adjustable planar sheet feeder structured and arranged to user-adjustably feed the at least one substantially planar sheet into the at least one magnetizer. The user 129 (FIG. 2) locates the adjustable guide 294 as required at one of the variable positions 300 on feed tray 112. The user 129 attaches the adjustable guide 294 as required.

Figure 15:
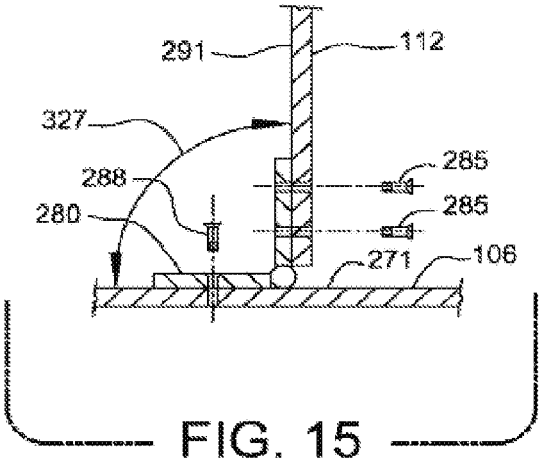
FIG. 15 is an enlarged partial cross-sectional view through the section 15-15 of FIG. 14, illustrating at least one hinge attaching feed tray to the panel.

FIG. 15 shows at least one hinge attaching the feed tray 112 to the panel 106. The feed tray 112 is attached to the panel 106 with at least one feed-tray hinge 280. The feed-tray hinge 280 is fastened to feed tray 112 with counter-sink screws 285. The feed-tray hinge 280 is fastened to the top 271 of panel 106 with at least one counter-sink screw 288. Other hinging attachments, such as, for example, piano hinges, pin hinges, flexible joints can provide an alternative to the arrangement shown.

Figure 16:
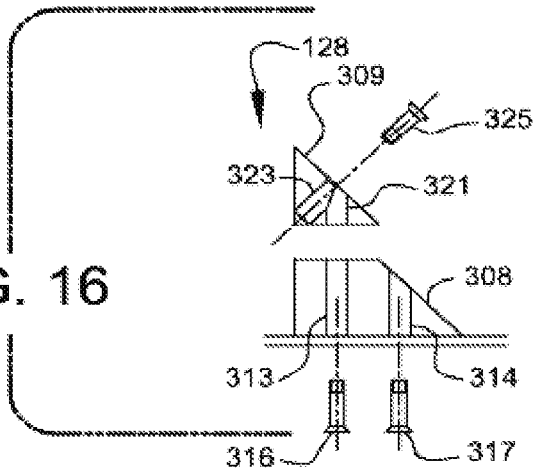
FIG. 16 is a side elevational view, illustrating the at least one tray mount of the at least one magnetizer array assembly shown in FIG. 14.

FIG. 16 shows the tray mount 128 for the arrangement shown in FIGS. 14 and 15. The tray mount 128 is used to deploy the feed tray 112 to the angled position 114 (FIG. 3). The feed tray 112 comprises the tray mount 128, for example, two (2) tray mounts 128. The tray mount 128 comprises a tray mount base 308 and a tray mount top 309. The tray mount base 308 comprises at least one threaded-hole 313 and at least one threaded-hole 314 to receive counter-sink screws 316 and counter-sink screw 317 respectively, preferably to mount the tray mount 128 to the panel 106, as shown in FIG. 17.

The tray mount top 309 comprises at least one hole 321 and at least one threaded hole 323. The threaded hole 323 receives the counter-sink screw 325 to hold the feed tray panel 291 to tray mount top 309.

When user is ready to deploy the feed tray 112 to the angled position 114, the feed tray 112 is positioned to up position 327, as shown in FIG. 15. The up position 327 allows the mounting of the tray mounts 128. The tray mounts 128 are mounted as previously described. The feed-tray panel 291 is then rotated back to the angled position 114. The feed-tray panel 291 is then secured to the tray mounts 128 with counter-sink screw 325. Other angled deployment methods, such as, for example, folding support arms, friction plates, locking hinges can provide an alternative to the arrangement shown.

FIG. 17 shows the feed tray 112 and tray mounts 128 deployed to operable configuration 109 (FIG. 16). The user 129 deploys the feed tray 112 by attaching the tray-mount base 308 to the top 271 of the panel 106. The counter-sink screw 316 and counter-sink screw 317 enter tray-mount base 308 from the underside 270 of the panel 106.

The tray-mount top 309 is attached to tray-mount base 308. The feed-tray panel 291 is secured to tray-mount top 309 in the angled position 114 by counter-sink screw 325. The feed-tray panel 291 is held by feed-tray hinges 280 and tray mounts 128. The feed-tray panel 291 is deployed to angled position 114 to place the feed tray 112 in the operable configuration 109.

The feed tray 112, secured to the tray mounts 128, positions the flexible magnetizable sheet 141 along the feed path 143 towards magnetizer array 104. The flexible magnetizable sheet 141 is positioned against the adjustable guide 294 as it is fed in. Other flexible-magnetic sheet positioner arrangements, for example, magnetic sheet hoppers, motorized feed systems, or alternate guides to interface with magnetizer can provide an alternative to the arrangement shown.

Figure 18:
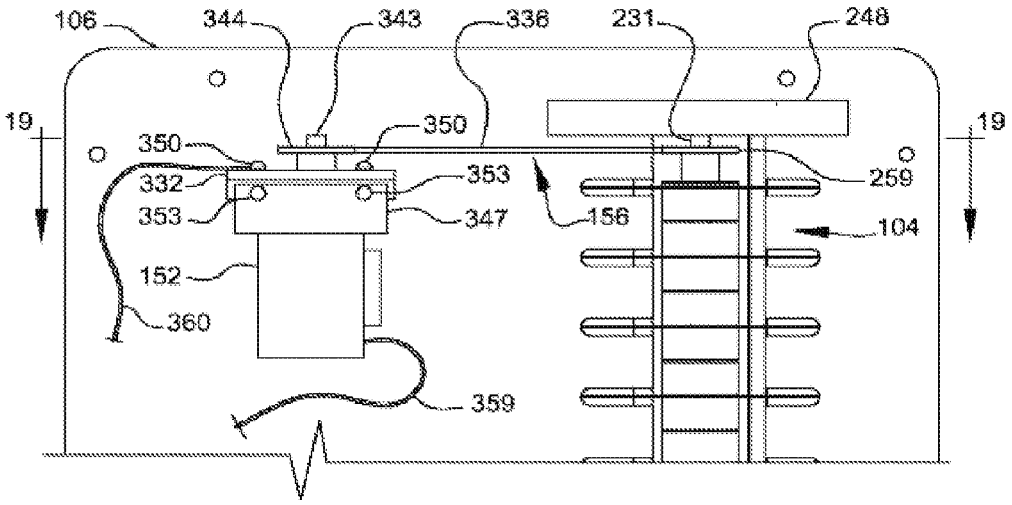
FIG. 18 is a partial bottom view of the magnetizer array assembly shown in FIG. 17, illustrating at least one motor and chain drive.
Figure 19:
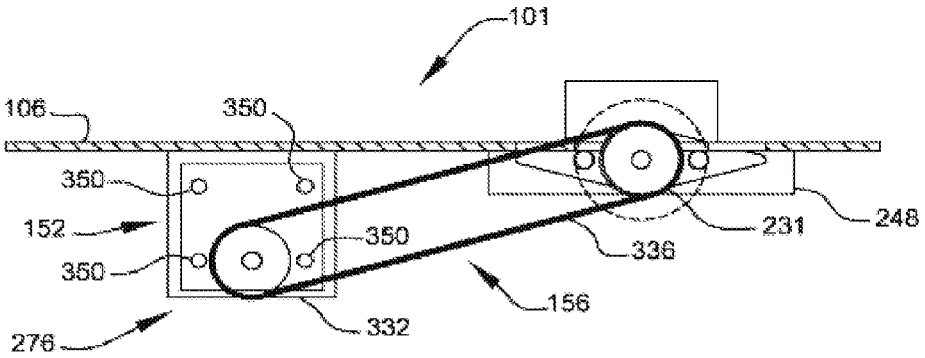
FIG. 19 is a cross-sectional view 19-19 of FIG. 18, illustrating such motor and chain drive.

FIG. 18 shows partial underside view of panel 106 illustrating at least one mechanical power subsystem 276 of the arrangement shown in FIG. 17. FIG. 19 shows the sectional view 19-19 of FIG. 18, illustrating the mechanical power subsystem 276.

The panel 106 encloses the mechanical power subsystem 276, and motor electrical connections in the lower portion 173 of briefcase enclosure 108, as shown in FIG. 4. The panel 106 also allows for easy mounting of magnetizer array 104 and mechanical power subsystem 276. The panel 106 also provides simplified access to maintain the magnetizer 101. In the event the magnetizer 101 requires maintenance or repairing, the panel 106 is removed for access to components of the magnetizer 101.

The mechanical power subsystem 276 comprises motor 152 and chain drive 156. The motor 152, for example, comprises at least one electric motor. For example, the motor 152 can be a McMaster Carr NC Gear Motor Part #6142K57. McMaster Can NC Gear Motor Part #6142K57 is available from McMaster Carr, 600 N. County Line Rd. Elmhurst, Ill. 60126-2081 (sales and customer service: 630-833-0300) or visit www.mcmaster.com on internet. The motor 152 also comprises gearbox 347 and a built in motor fan preventing overheating of motor 152. Other motors, for example, pneumatic motors, hydraulic motors, hand-actuated gearboxes can provide an alternative to the arrangement shown.

The motor 152 is attached to at least one angle bracket 332 by at least one motor-mount screw 350. The angle bracket 332 is attached to panel 106 by motor-bracket screws 353.

The chain drive 156 connects the motor 152 to the gear-drive endplate 259 on magnetizer array 104. The chain drive 156 comprises 336, gear-drive end plate 259, motor-shaft 343, and motor-gear 344. The motor 152 connects to the gearbox 347. The gearbox 347 connects to the motor-shaft 343. The motor-shaft 343 connects to motor-gear 344. The chain 336 connects the motor-gear 344 to the gear-drive end plate 259 on the shaft 231. Other rotary movement to shaft transfer arrangements such as, for example, gear transmission systems, belt drive, or direct drive systems can provide an alternative to the arrangement shown.

The motor 152 comprises a motor-power wire 359, motor grounding wire 360 connected to fuse 177, power cord receptacle 122, and power switch 131 (FIG. 1). The fuse 177, power cord receptacle 122, and power switch 131, are attached to the briefcase enclosure 108 as best shown in FIG. 1. The portable magnetizer 105 is fused for safety. The motor 152 is wired to the fuse 177, power cord receptacle 122, and power switch 131 in conventional electrical configuration.

The power switch 131 activates the motor 152. The motor 152 drives the gearbox 347. The gearbox 347 rotates the motor-shaft 343 and the motor-gear 344. The motor-gear 344 moves the chain 336. The motor-gear 344 drives the gear-drive end plate 259, for example, at about a one-to-one revolution ratio. The rotation of gear-driven end plate 259 drives the shaft 231 and magnetic roller 133. Other rotary movement generator arrangements such as, for example, air motors, air powered motors, appliance motors, pneumatic motors, DC motors, hand crank, solar powered motors, or battery powered motors can provide an alternative to the arrangement shown.

Figure 20:
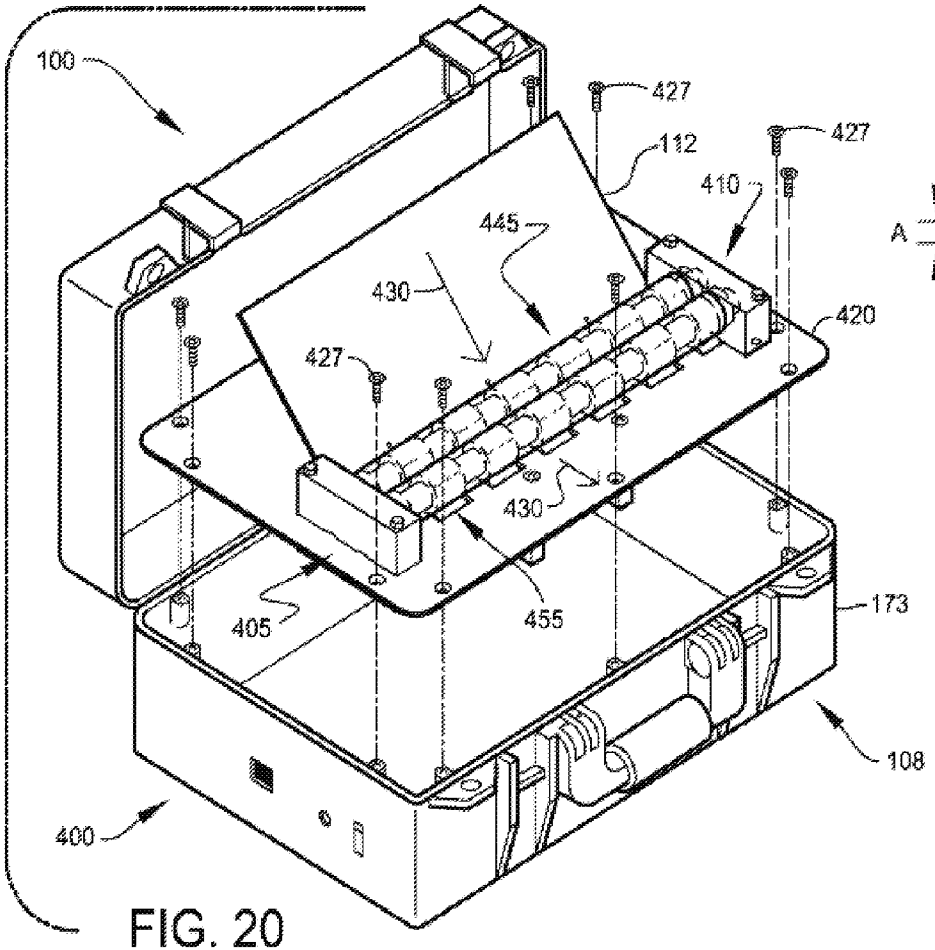
FIG. 20 is a partial-exploded perspective view illustrating an alternative at least one high-energy portable magnetizer.

FIG. 20 shows a high-energy portable magnetizer 400. As many of the elements of the high-energy portable magnetizer 400 are retained from portable magnetizer 105, only structures and arrangements differing from the portable magnetizer 105 will be described.

The high-energy portable magnetizer 400 replaces the magnetizer array assembly 205 of portable magnetizer 105 with a high-energy magnetizer array assembly 405. The high-energy magnetizer array assembly 405 comprises at least one upper magnetic field source 445 and at least one lower magnetic field source 455, as shown in FIG. 21.

Figure 21:
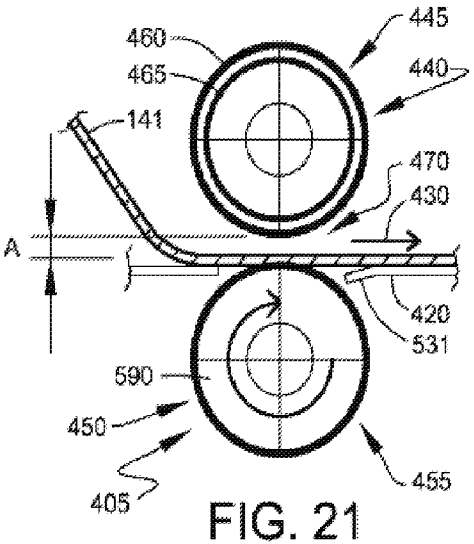
FIG. 21 is a diagrammatic side view, illustrating at least one feed path through the at least one high-energy portable magnetizer shown in FIG. 20.

FIG. 21 shows the feed path 430 extending through the high-energy magnetizer array assembly 405 of the arrangement shown in FIG. 20. The lower magnetic field source 455 comprises at least one magnetic roller assembly 450. The upper magnetic field source 445 comprises at least one magnetic bar assembly 440. The upper magnetic bar assembly 440 and the lower magnetic roller assembly 450 are located to form a gap 470 therebetween. The gap 470, for example, can be a distance A of about ⅛ inch. The feed path 430 extends through the gap 470 in an orientation perpendicular to the longitudinal axes of magnetic bar assembly 440 and the magnetic roller assembly 450. Due to the relative positions of the magnetic bar assembly 440 and the magnetic roller assembly 450, the gap 470 comprises at least one region of high magnetic flux.

The feed tray 112 (FIG. 20) functions to assist the positioning of the flexible magnetic sheet 141 in an initial position within the feed path 430. In addition, the feed tray 112 assists in guiding the flexible magnetic sheet 141 towards the gap 470 and the lower magnetic roller assembly 450. The lower magnetic roller assembly 450 is configured to drive the flexible magnetic sheet 141 along the feed path 430 through the gap 470, similar to the previously-described magnetic roller 133.

Figures 22, 23:
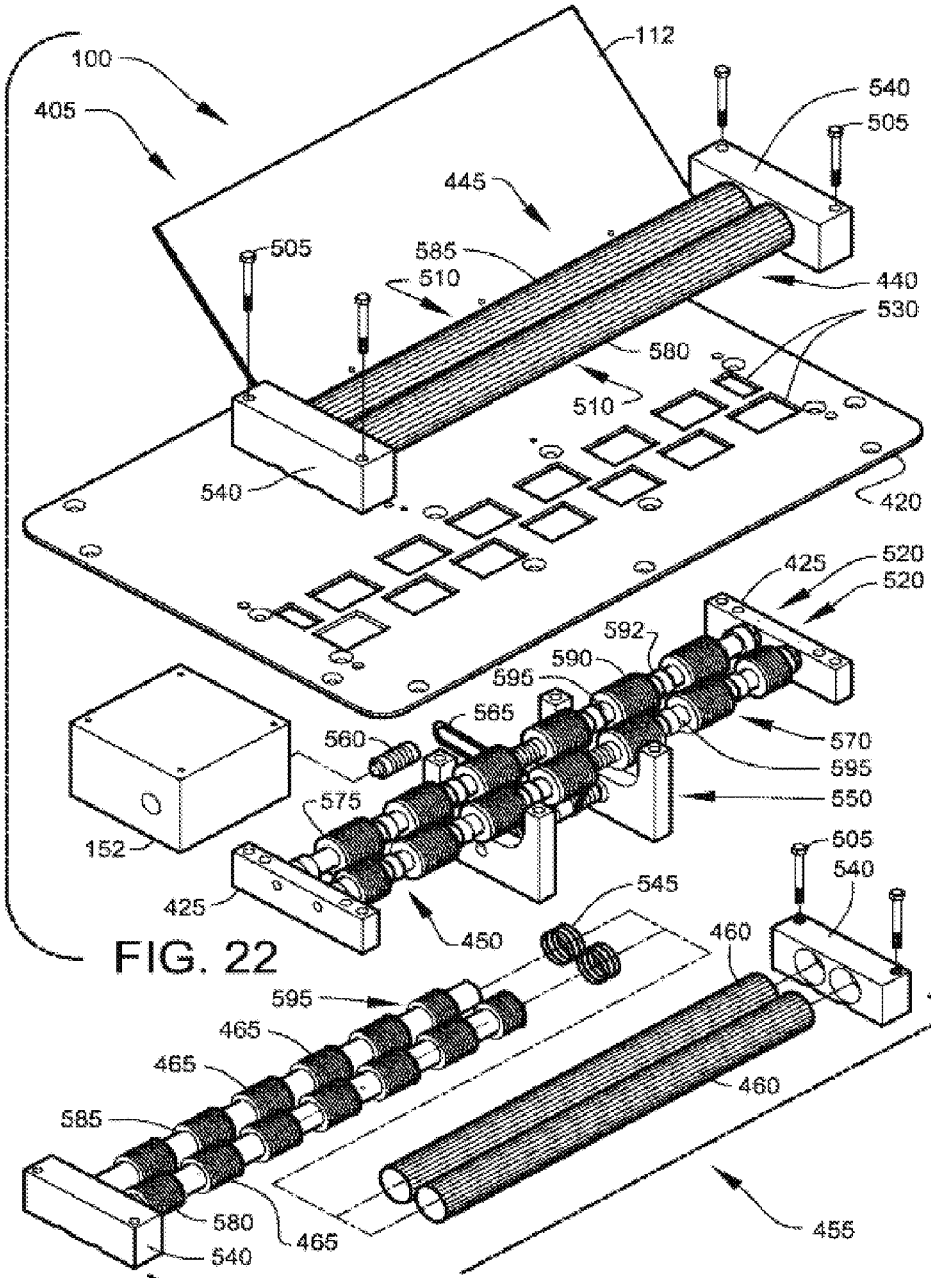
FIG. 22 is an exploded perspective view, illustrating the at least one high-energy magnetizer array assembly shown in FIG. 21.
FIG. 23 is an exploded perspective view, illustrating at least one upper magnetizer array subassembly of the at least one high-energy magnetizer array shown in FIG. 22.

FIG. 22 shows the high-energy magnetizer array assembly 405 of the arrangement shown in FIG. 21. FIG. 23 shows the arrangement of the upper magnetic bar assembly 440. The upper magnetic bar assembly 440 comprises at least one upper magnetizer array subassembly 510, for example, at least two magnetizer array subassemblies 510, as shown. The magnetic bar assembly 440 comprises at least one smooth outer casing 460 and at least one magnetic stack 465 contained within the outer casing 460, as shown. The outer casing 460 comprises at least one magnetically transparent material (i.e. material that does not significantly attenuate a magnetic field passing through the material), for example, brass material. Other magnetically transparent materials, such as, for example, magnetically-transparent plastics, magnetically-transparent ceramics, other magnetically transparent metals can provide an alternative to the arrangement shown.

Correspondingly, the lower magnetic roller assembly 450 comprises a magnetizer array subassembly 520, for example, at least two magnetizer array subassemblies 520, as shown. The functional relationship between the two lower magnetizer array subassemblies 520 is representative of the functional relationship between the two upper magnetizer array subassemblies 510. For conciseness and clarity of description, the functional relationship between the two magnetizer array subassemblies 520 will be discussed with the understanding that the teachings are equally applicable to the functional relationship between the two upper magnetizer array subassemblies 510.

Each magnetizer array subassembly 520 comprises a leading magnetic roller 575 and preferably at least one trailing magnetic roller 570. Each upper magnetizer array subassembly 510 preferably comprises a leading magnetic bar 585 and preferably at least one trailing magnetic bar 580. Both the magnetic roller assemblies 450 and magnetic bar assemblies 440 extend across substantially the full width of the feed path 430 and the flexible magnetic sheet 141.

The leading magnetic roller 575 comprises a rotational shaft 595 oriented substantially perpendicular to the line of direction of the feed path 430 (as generally defined by the direction of sheet motion), as shown. The leading magnetic roller 575 comprises a first set of magnetic stacks 590 spaced substantially along the length of rotational shaft 595, as shown. Each magnetic stack 590 comprises an alternating sequence of magnetic plates and flux-conducting plates in a configuration matching those of the previously-described magnetic stacks 239 shown and described in FIG. 8A and FIG. 8B. Each magnetic plate comprises a high-strength permanent magnet and each flux-conducting plate comprises a material exhibiting high permeability when saturated. Both magnetic plates and flux-conducting plates comprise substantially circular peripheral shapes. Each substantially circular magnetic plate and each substantially circular flux-conducting plate are preferably substantially coaxial with the rotational shaft 595, as shown. Thus, the sequential laminations of each magnetic stack 590 form a substantially cylindrical peripheral surface.

The magnetic stacks 590 are mounted coaxially on the rotational shaft 595. The magnetic stacks 590 are separated by a set of spacers 592 that are also mounted coaxially on the rotational shaft 595. The spacers 592 comprise widths generally slightly shorter than those of the magnetic stacks 590. As in the prior magnetic stacks 239, magnetic stacks 590 each comprise a 16-PPI stack 237, as shown in FIG. 8A. The magnetic stacks 590 for the high-energy magnetizer array assembly 405, for example, comprise a length of about 1⅛ inch. The spacers 592, for example, comprise a width of about 1 inch (1").

The structures and arrangements of the upper leading magnetic bar 585 are substantially identical to those of the lower leading magnetic roller 575, as described above. The placements of the magnetic stacks 465 along the rotational shaft 595 of the leading magnetic bar 585 are substantially identical to those of leading magnetic roller 575. This places the magnetic stacks 465 of the leading magnetic bar 585 in vertical alignments with the magnetic stacks 590 of the leading magnetic roller 575. Thus, a plurality of first high-magnetic-flux field regions (six in the depicted) are generated within the leading gap 645 (FIG. 26) by the vertical stacking of leading magnetic roller 575 below the leading magnetic bar 585 and the resulting formation of magnetic flux circuits between the leading magnetic roller 575 and the leading magnetic bar 585.

The structures and arrangements of trailing magnetic roller 570 are substantially similar to those of leading magnetic roller 575, with the exception of the positioning of magnetic stacks 590 along rotational shaft 595, as shown. It is noted that the magnetic stacks 590 of the trailing magnetic roller 570 are preferably axially offset from the magnetic stacks 590 of the leading magnetic roller 575. More preferably, the magnetic stacks 590 of the trailing magnetic roller 570 are axially offset a distance substantially equal to the width of the magnetic stack 590, as shown. Similarly, magnetic stack 465 of the upper trailing magnetic bar 580 are axially offset from magnetic stack 465 of the upper leading magnetic bar 585 centering the magnetic stacks 590 of leading magnetic roller 575 on the spacers 592 of the trailing magnetic roller 570. This preferred arrangement produces a plurality of second high-magnetic-flux field regions (seven depicted) within the trailing gap 640 (FIG. 26), each of the second high-magnetic-flux field regions generated by the vertical stacking of trailing magnetic roller 570 below trailing magnetic bar 580. It is noted that the plurality of the second high-magnetic-flux field regions of the trailing gap 640 are axially offset from the plurality of the first high-magnetic-flux field regions of the leading gap 645.

The axial offsetting of the above-described magnetic stacks assures that the full width of flexible magnetic sheet 141 is exposed to at least one of the above-described high-magnetic-flux field regions as it is advanced along feed path 430, as shown. Thus, magnetization of flexible magnetic sheet 141 preferably occurs in parallel strips defined by alternating exposure to the magnetic fields of the leading and trailing magnetic rollers. The axial offsetting has been determined to reduce feed-related problems related to the adhering and wrapping of flexible magnetic sheet 141 around the magnetic rollers during operation. Other magnet arrangements, such as utilizing a continuous array of magnets extending substantially across the sheet width can provide an alternative to the arrangement shown.

The high-energy magnetizer array assembly 405 comprises a magnetizer array plate 420. The magnetizer array plate 420 mounts to lower portion 173 of briefcase enclosure 108, as shown in FIG. 20, with the mounting fasteners 427, for example, being mounting screws. Other mounting fasteners, such as, for example, bolts, snap-fit fasteners, twist-lock fasteners can provide an alternative to the arrangement shown.

The magnetizer array plate 420 includes a set of rectangular-shaped apertures 530, preferably arranged in an offset configuration, as shown, corresponding to the layout of magnetic stacks 590 of leading magnetic roller 575 and trailing magnetic roller 570. The rectangular-shaped apertures 530 preferably allow the magnetic stacks 590 of magnetic roller assembly 450 to project upwardly through magnetizer array plate 420 to contact flexible magnetic sheet 141, as shown in FIG. 21. The trailing edge of each aperture 530 and opening preferably comprises an angled ramp 531, as diagrammatically shown in FIG. 21. The angled ramps 531 assist in maintaining smooth and consistent feed performance by reducing the tendency of the flexible magnetic sheet to contact the trailing edge of the apertures due to magnetic adherence to the magnetizer banks. Each angled ramp 531 comprises a tapered cut within the plate. More preferably, the angled ramps 531 are formed by modifying a section of the plate to allow bending of the trailing edge of the aperture downward, as diagrammatically shown in FIG. 21.

The upper magnetic bar assembly 440 preferably mounts above magnetizer array plate 420, preferably outside lower portion 173 of briefcase enclosure 108. The lower magnetic roller assembly 450 preferably mounts below magnetizer array plate 420, preferably inside lower portion 173 of briefcase enclosure 108. At least one magnetizer array mounting fastener 505 preferably secures both the upper magnetic bar assembly 440 and the lower magnetic roller assembly 450, preferably by passing through magnetizer array plate 420, as shown. Magnetizer array mounting fastener 505 preferably comprises at least one bolt.

The magnetizer array mounting fastener 505 preferably secures at least one lower mounting bracket 425 to upper mounting bracket 540, preferably sandwiching magnetizer array plate 420 therebetween. At least two lower mounting brackets 425 preferably hold the lower magnetizer array subassemblies 520, and at least two upper mounting brackets 540 preferably hold the upper magnetizer array subassemblies 510 in operable positions, as shown.

Each of the upper magnetizer array subassemblies 510 preferably further comprise at least one roller float spring 545, preferably at least two roller float springs 545. Roller float springs 545 preferably are positioned at each end of a respective magnetic bar, preferably inside outer casing 460. Roller float springs 545 preferably allow the series of magnetic stacks 465 to shift in a longitudinal direction, preferably to magnetically align with the lower magnetic stacks 590. In one preferred arrangement, outer casing 460 is preferably free to rotate in upper mounting bracket 540 and the internal magnetic bar is preferably free to longitudinally slide inside outer casing 460.

Preferably, leading magnetic bar 585 and trailing magnetic bar 580 are thereby free to translate in order to achieve optimal alignment with the upper and lower magnetic stacks, thus optimizing the high-magnetic-flux regions, as described herein. Upon reading the teachings of this specification, those skilled in the art will now appreciate that, under appropriate circumstances, considering such issues as cost, future technologies, etc., other mounting arrangements, such as, for example, vertically shifting outer casings, fine gap adjustments, etc., may suffice.

Figures 27B, 28:
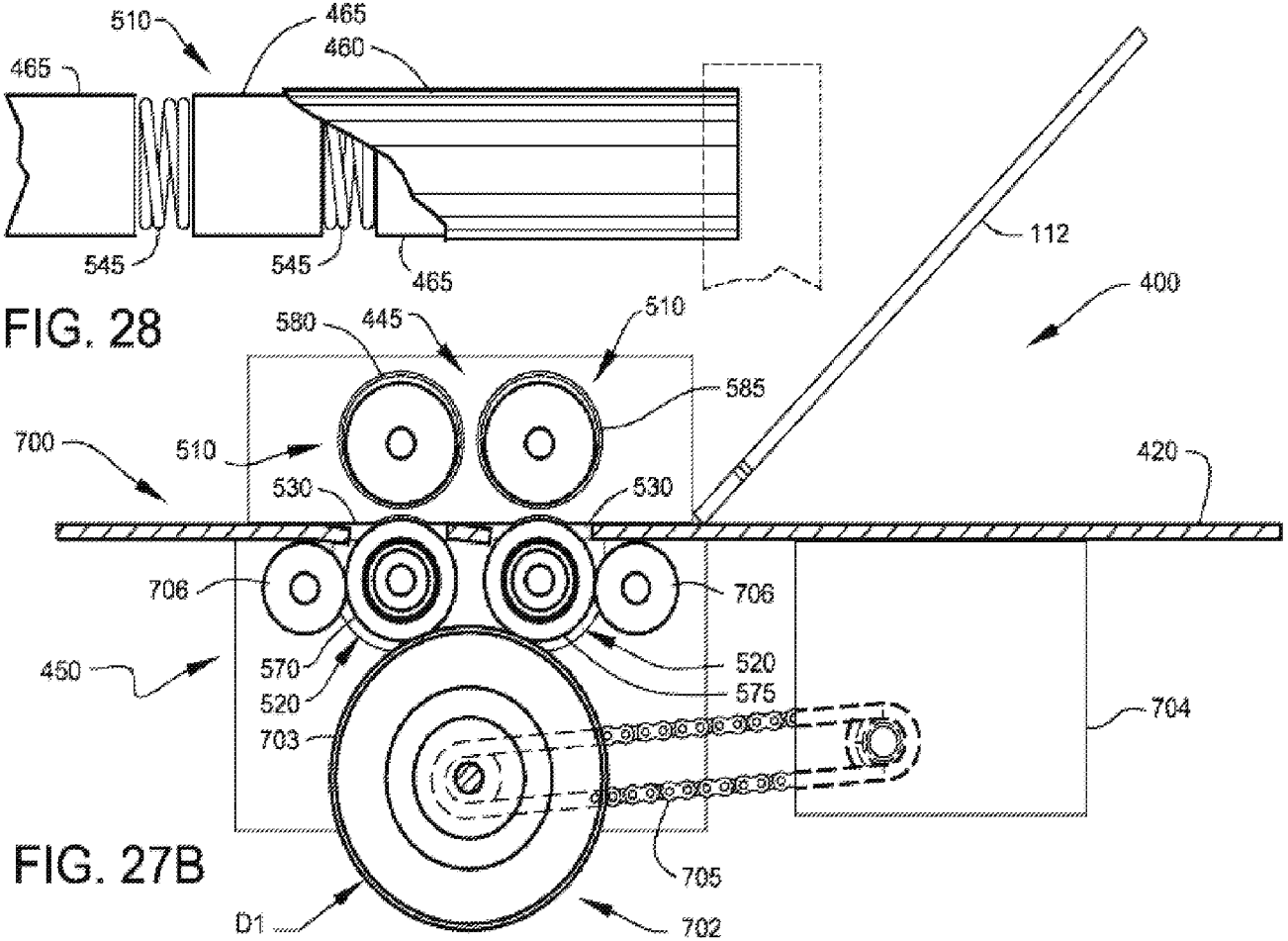
FIG. 27B is a sectional view 27B-27B of FIG. 27A, illustrating the alternative rotational drive subassembly of FIG. 27A
FIG. 28 is a partial cut-away front view, illustrating an alternative high-energy magnetizer array assembly.

Alternately preferably, each magnetic stack 465 of the upper magnetizer array subassemblies 510 are preferably separated by a roller float spring 545, as illustrated in FIG. 28. This alternate preferred arrangement permits each magnetic stack 465, of the upper magnetic bars, to align with a corresponding magnetic stack 590 of the adjacent of lower magnetizer array subassembly 520.

The lower magnetic roller assembly 450 preferably connects to motor 152 with at least one rotational drive subassembly 550. Motor 152 preferably attaches to at least one motor drive shaft 560, and preferably rotates motor drive shaft 560 during operation. Motor drive shaft 560 preferably attaches to rotational drive subassembly 550 with at least one motor drive belt 565, as shown. Upon reading the teachings of this specification, those skilled in the art will now appreciate that, under appropriate circumstances, considering such issues as cost, future technologies, etc., other drive train connections, such as, for example, chains, gears, rollers, etc., may suffice.

Figure 24:
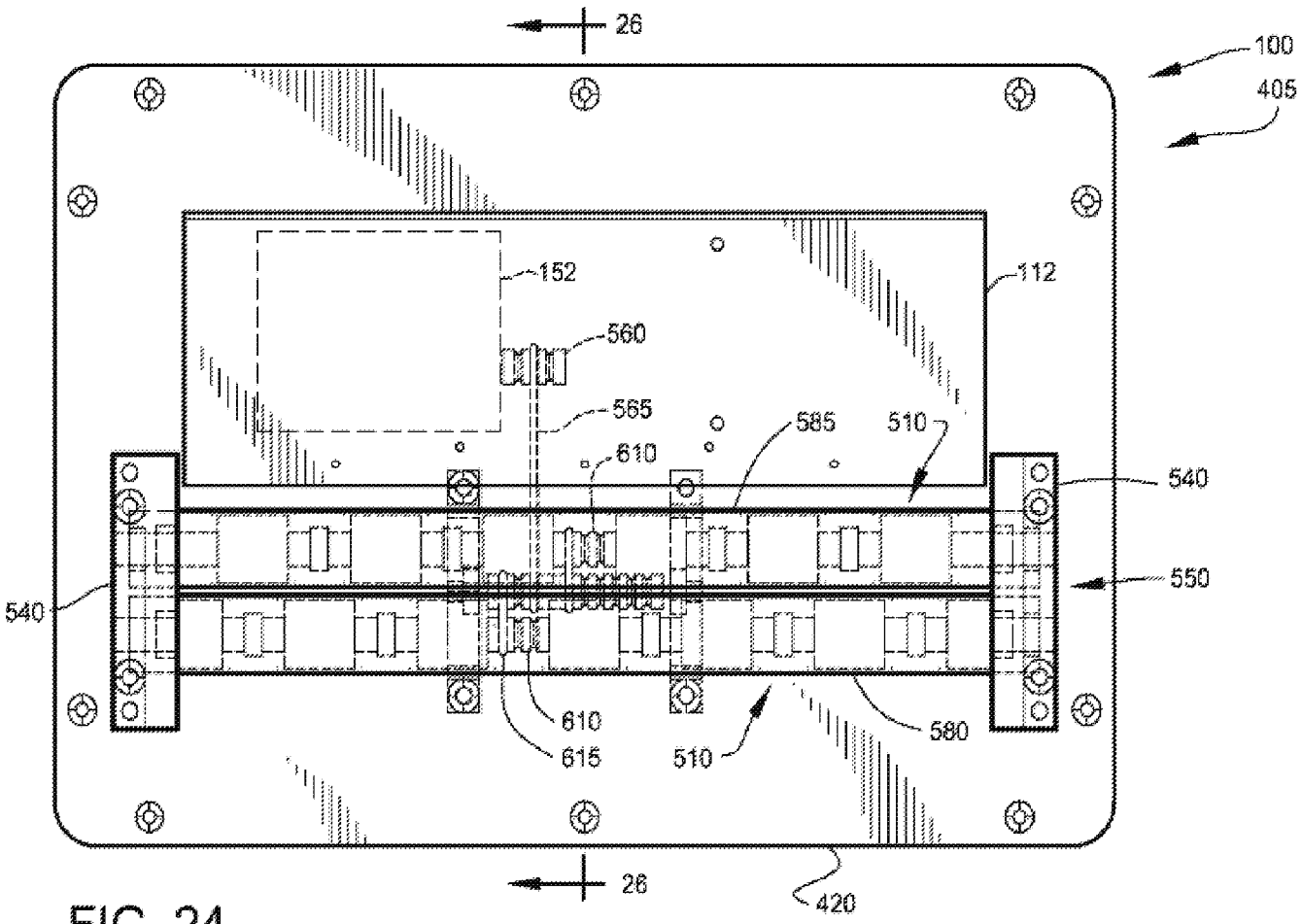
FIG. 24 is a top view of the at least one high-energy magnetizer array assembly shown in FIG. 23, illustrating the at least one rotational drive subassembly.
Figure 25:
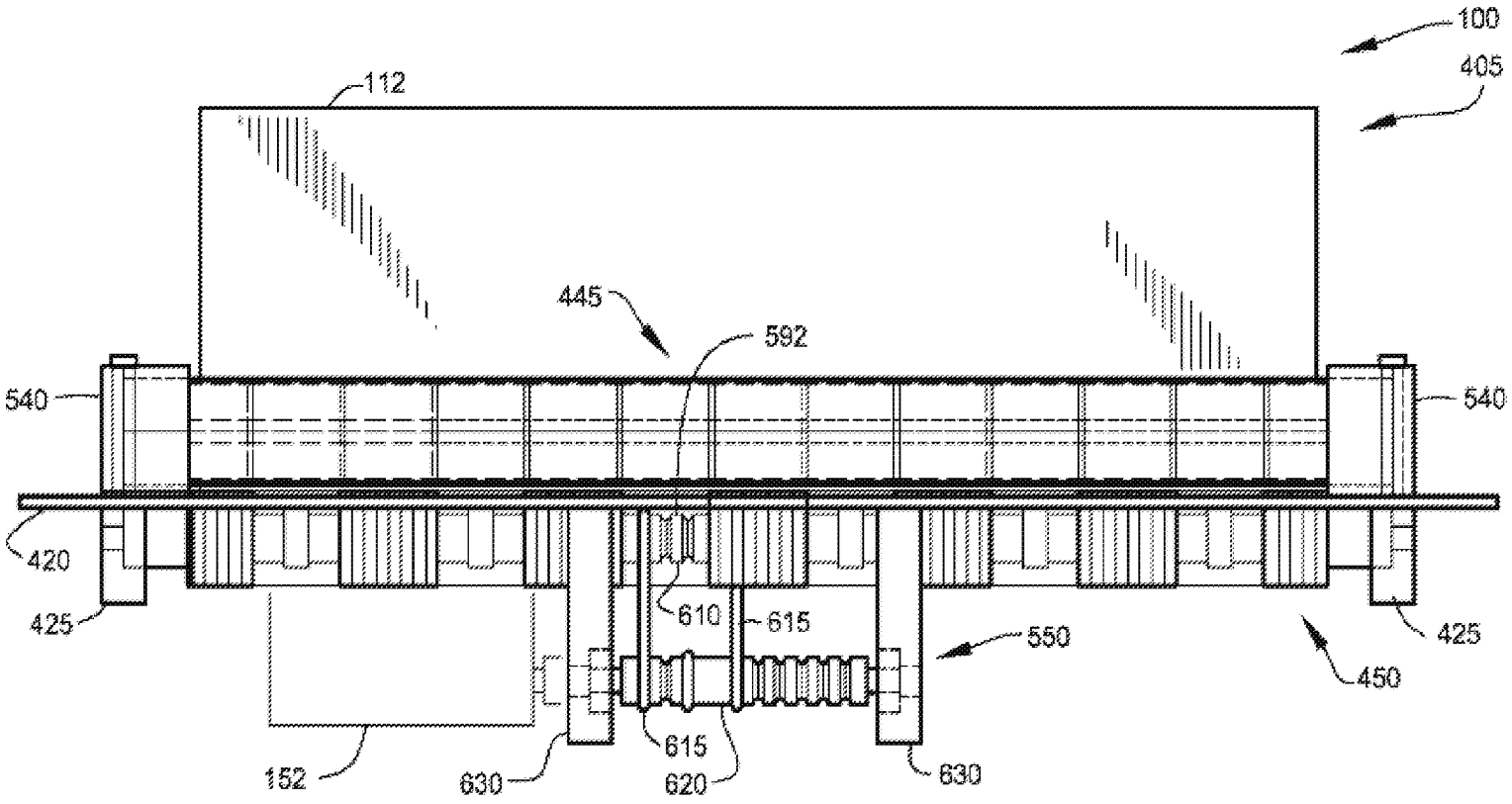
FIG. 25 is a front view of the at least one high-energy magnetizer array assembly shown in FIG. 23, illustrating such at least one rotational drive subassembly.
Figure 26:
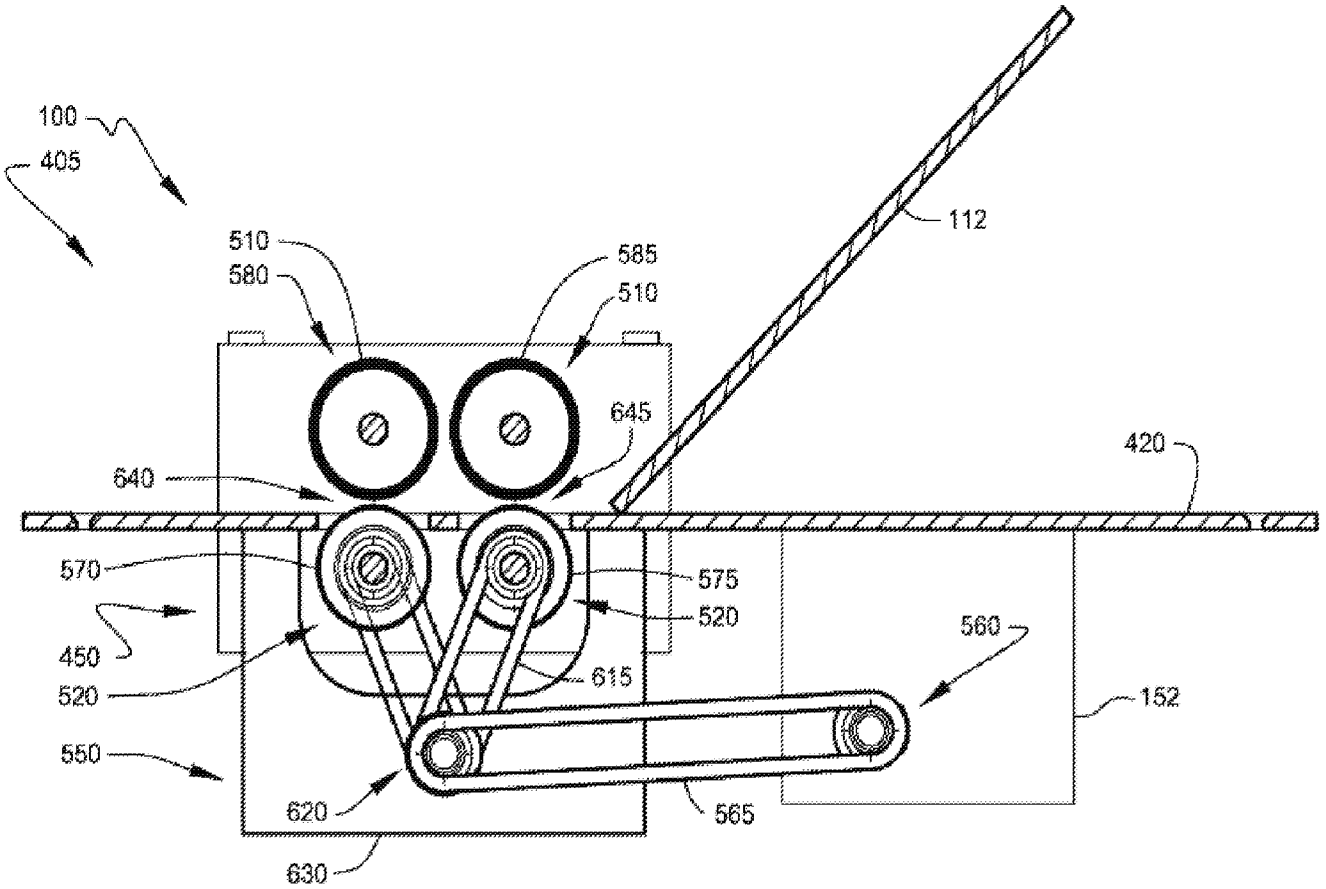
FIG. 26 is a cross-sectional view 26-26 of FIG. 24, illustrating the high-energy magnetizer array assembly.

FIG. 24 shows a top view of high-energy magnetizer array assembly 405, illustrating rotational drive subassembly 550, according to the preferred embodiment of FIG. 22. FIG. 25 shows a front view of high-energy magnetizer array assembly 405, illustrating rotational drive subassembly 550, according to the preferred embodiment of FIG. 22. FIG. 26 shows the sectional view 26-26 of FIG. 24, illustrating rotational drive subassembly 550.

Rotational drive subassembly 550 preferably comprises at least one drive assembly mount 630, at least one roller drive shaft 620, and at least one roller drive belt 615. Rotational drive assembly 550 preferably transfers rotations motion from motor 152 to magnetic roller assembly 450, preferably in a 1:1 ratio. Upon reading the teachings of this specification, those skilled in the art will now appreciate that, under appropriate circumstances, considering such issues as cost, future technologies, etc., other rotational drive assemblies, such as, for example, gear boxes, direct drives, chain drives, friction roller drives, etc., may suffice.

Drive assembly mount 630 preferably mounts roller drive shaft 620 under magnetic roller assembly 450, as shown in FIG. 25. Roller drive belt 615 preferably connects roller drive shaft 620 to magnetic roller assembly 450, preferably transferring rotational motion during operation. Each magnetic roller preferably comprises at least one drive spacer 610, preferably where roller drive belt 615 attaches, preferably comprising at least one of spacers 592. Motor drive belt 565 preferably transfers rotational motion from motor drive shaft 560 to roller drive shaft 620, during operation.

Figure 27A:
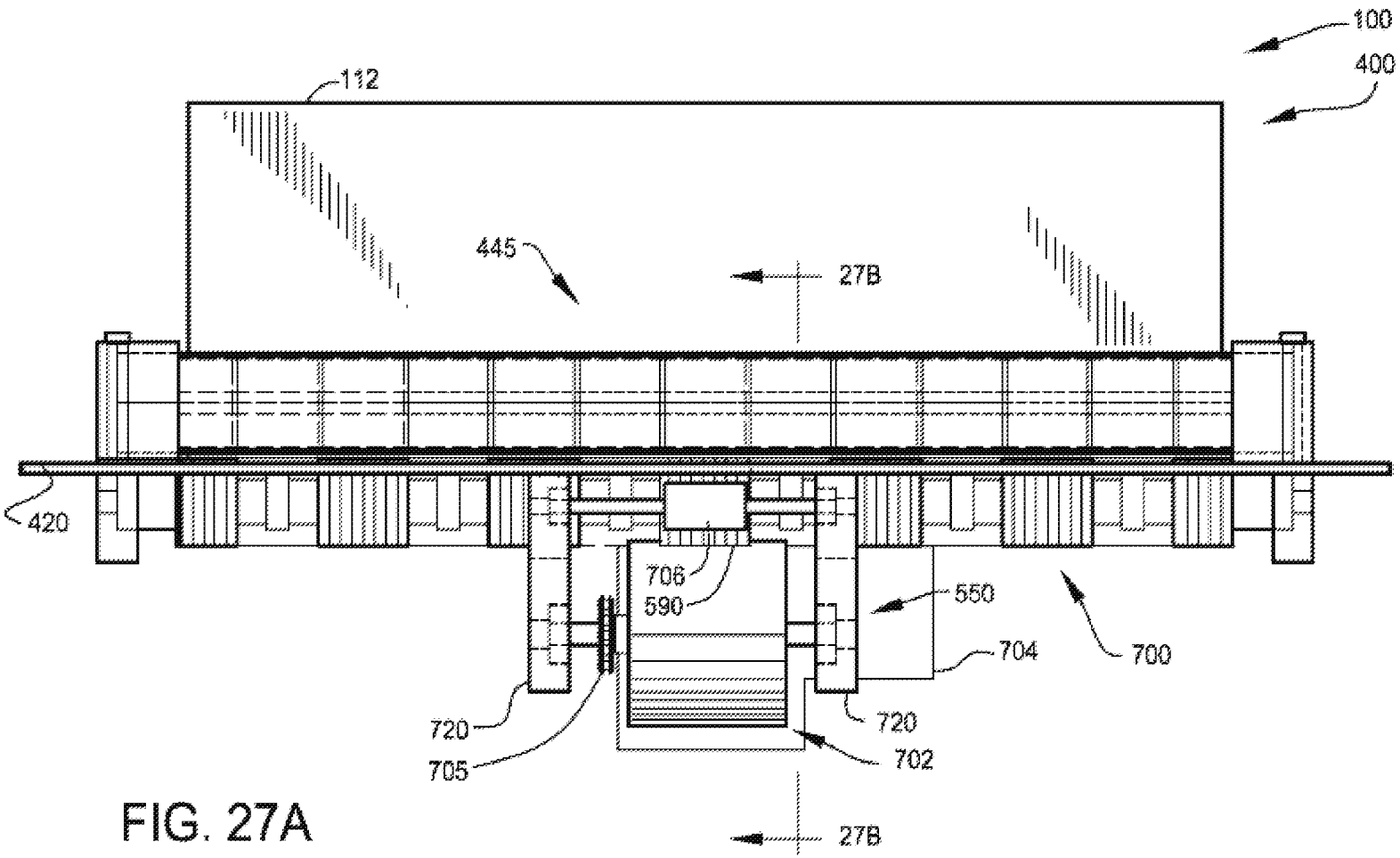
FIG. 27A is a front view of a further alternative high-energy magnetizer array assembly, illustrating an alternative rotational drive subassembly.

FIG. 27A shows a front view of an alternate high-energy portable magnetizer 400, modified to comprise alternate rotational drive subassembly 700, according to another preferred embodiment of the present invention. FIG. 27B shows the sectional view 27B-27B of FIG. 27A, illustrating the alternate rotational drive subassembly 700 of FIG. 27A.

Alternate rotational drive subassembly 700 differs from the prior embodiment in that magnetic roller assembly 450 is driven by a large-diameter shaft-mounted drive roller 702, as shown. Drive roller 702 preferably comprises a resilient outer surface 703, as shown. Resilient outer surface 703 of drive roller 702 preferably comprises at least one synthetic rubber, preferably a urethane material having a 35 A durometer hardness. Drive roller 702 preferably comprises an outer diameter D1 of about 2½ inches. One preferred urethane roller suitable for use as drive roller 702 comprises a unit having a width of about 1.9 inches and an internal bore of about 1 inch, preferably a McMaster Can urethane roller Part number 2475K104 available from McMaster Carr, located at 600 N. County Line Rd. Elmhurst, Ill. 60126-2081. Drive roller 702 is preferably figured to be coupled to motor 704 by chain drive 705, as shown. In this preferred alternate arrangement, motor 704 preferably comprises a McMaster Carr AC Gear motor, part number 6142K58, providing about 75 revolutions per minute, about 10-inch pounds of torque, and preferably operating on a 115 volts alternating circuit.

Drive roller 702 is preferably mounted to the underside of magnetizer array plate 420 by a set of side-positioned mounting plates 720, as shown. Mounting plates 720 are preferably configured to support drive roller 702 while preferably providing clearance to accommodate free rotation of magnetic roller assembly 450. This preferred mounting arrangement preferably places the resilient outer surface 703 of drive roller 702 in direct contact with one or more magnetic stacks 590 of the lower magnetic roller assembly 450, as shown. Preferably, rotation of leading magnetic roller 575 and trailing magnetic roller 570 is induced by the operation of motor 704 acting through chain drive 703 and drive roller 702.

In addition, alternate rotational drive subassembly 700 preferably comprises a set of rotatable magnet stay rollers 706, preferably configured to limit load deflections and maintain positioning of leading magnetic roller 575 and trailing magnetic roller 570 within magnetic roller assembly 450 during operation. Preferably, deflection within each magnetic roller is limited by the application of a force to the lower magnetic roller assembly 450 opposing the upward force applied to magnetic roller assembly 450. Magnet stay rollers 706 are preferably located adjacent each magnetic roller, preferably in front of leading magnetic roller 575 and behind trailing magnetic roller 570, as shown. Magnet stay rollers 706 preferably each comprise McMaster Carr Part number 2473K22 comprising a press-fit drive roller having about a ¾-inch outer diameter and about a ¾-inch width with a ¼-inch inside bore diameter. Magnet stay rollers 706 are preferably rotatably supported within the support of side mounting plates 720, as shown.

The above-described preferred arrangements of alternate rotational drive subassembly 700 have been found by applicant to provide improved performance in conjunction with the high-energy embodiments. In particular, the above-described preferred arrangement of alternate rotational drive subassembly 700 preferably provide reduced noise during operation, sufficient torque transfer within the high magnetic field pathway, and provides reduced wear in service.

Figure 29:
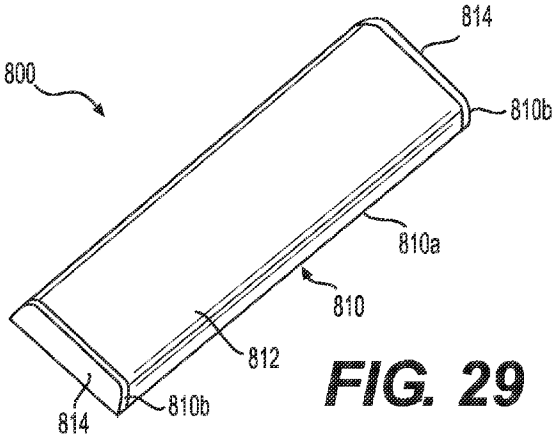
FIG. 29 is a top perspective view of a hand held portable magnetizer device.
Figure 30:
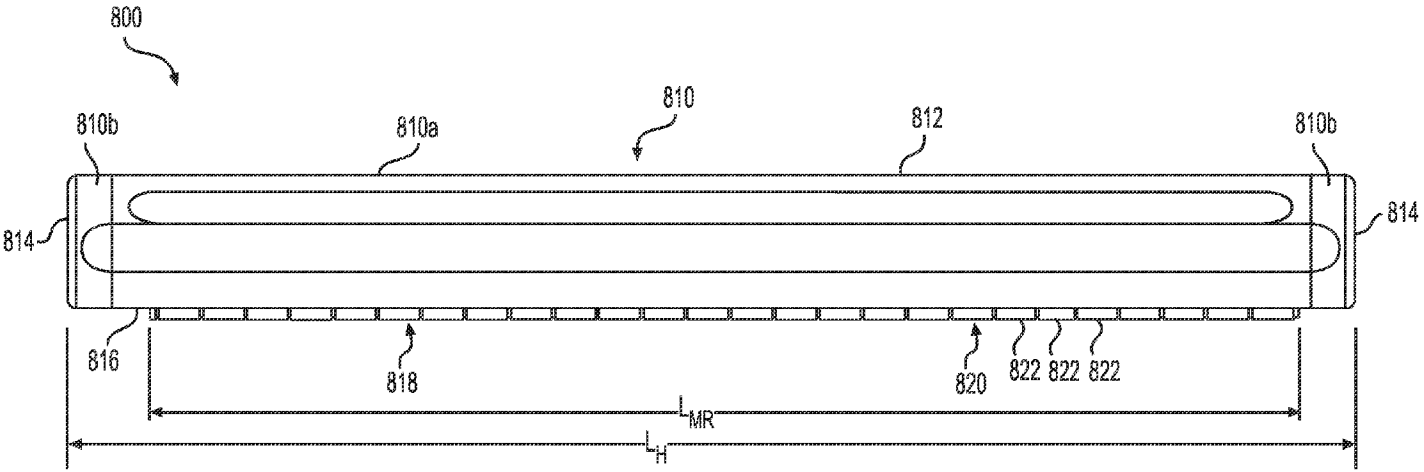
FIG. 30 is a front elevational view of the hand held portable magnetizer device shown in FIG. 29.

A hand held portable high energy magnetizer device 800 is shown in FIGS. 29-35. The magnetizer device 800 comprises a housing 810 having an upper portion 812, end portions 814, and a bottom portion 816, as shown in FIGS. 29 and 30. The housing 810, for example, can be made of plastic material (e.g. Nylon material) that is formed, for example, on a three-dimensional (3D) printer, injection molded, extruded, machined from a block of plastic material, or other suitable manufacturing process.

Figure 32:
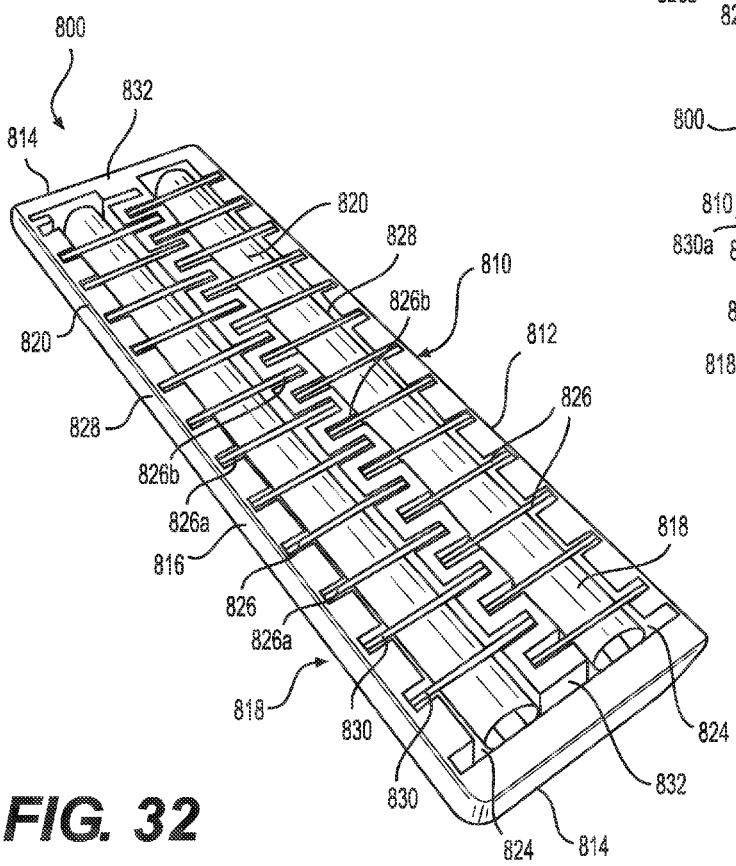
FIG. 32 is another bottom perspective view the hand held portable magnetizer device shown in FIGS. 29-31.

The magnetizer device 800 further comprises a magnetizer 818 comprising magnetic rollers 820 having pairs of magnetic stacks 822 supported on a pair of shafts 824, as shown in FIG. 32. The magnetizer device 800 is configured to be positioned on top of the flexible magnetizable sheet 848 and then a user manually propels the magnetizer device 800 by pushing or pulling the magnetizer device 800 along the length of the flexible magnetizable sheet 848 material to rotate the magnetic rollers 820 in contact with the upper surface of flexible magnetizable sheet 848 to magnetize same.

Figure 33:
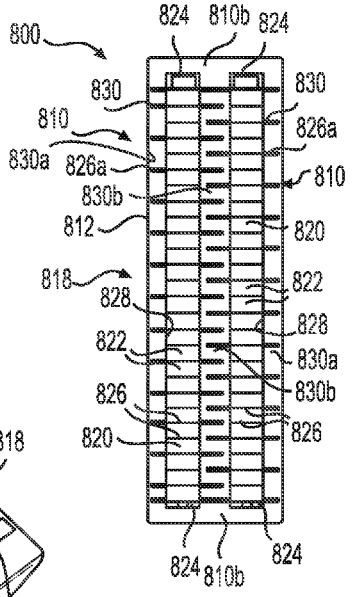
FIG. 33 is a bottom planar view of the hand held portable magnetizer device shown in FIGS. 29-32.

Each magnetic rollers 820 comprises a pair of side-by-side magnetic stacks 822 separated by stripper plates 826 supported on the shafts 824, as shown in FIG. 33. The stripper plates 826 include through holes (not shown) to accommodate the shafts 824, which freely rotate within the through holes. For example, the magnetic stacks 822 can be 12-PPI stacks the same as or similar to the 12-PPI stacks 235 discussed above.

The magnetic rollers 820 are received within recesses 828 located in the bottom side of the housing 810, as shown in FIG. 32. The ends 826*a* of the stripper plates 826 are also received within the recesses 830 located in the bottom side 816 of the housing 810. The length of the magnetic rollers 820 ($L_{MR}$) is less than the length of the housing 810 ($L_H$) so that the ends of the magnetic rollers 820 are offset inwardly from the end sides 814 of the housing 810.

Figure 31:
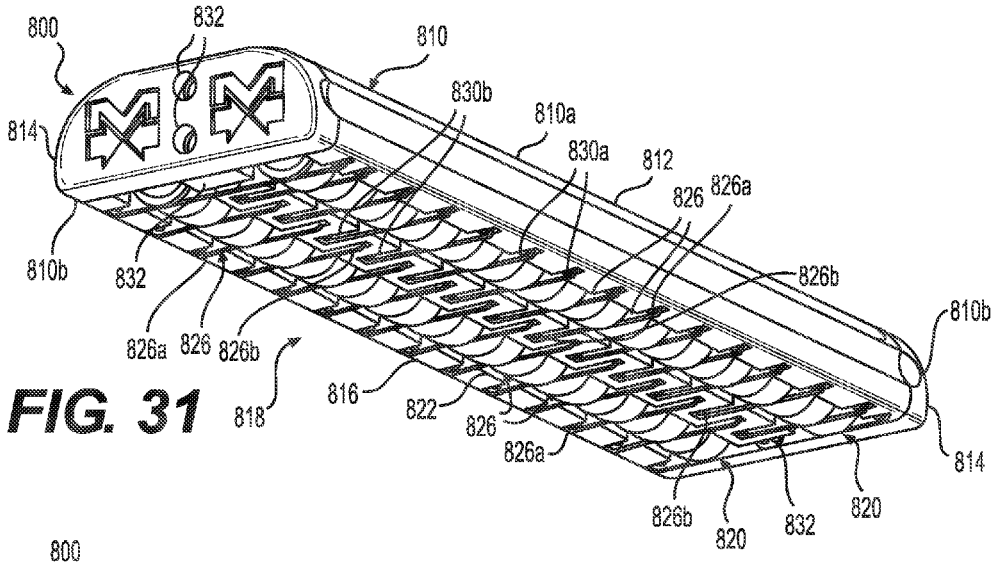
FIG. 31 is a bottom perspective view of a hand held portable magnetizer device shown in FIGS. 29 and 30.

The housing 810 includes an elongated center portion 810*a* connected to end plates 810*b*. For example, the end plates 810*b* are connected to the center portion 810*a* by bolts or screws (not shown) located in recesses 832 of the end plates 810*b*, as shown in FIG. 31. The ends of the bolts or screws are received within bosses 832 located on the bottom side 816 of the housing 810.

Figure 34:
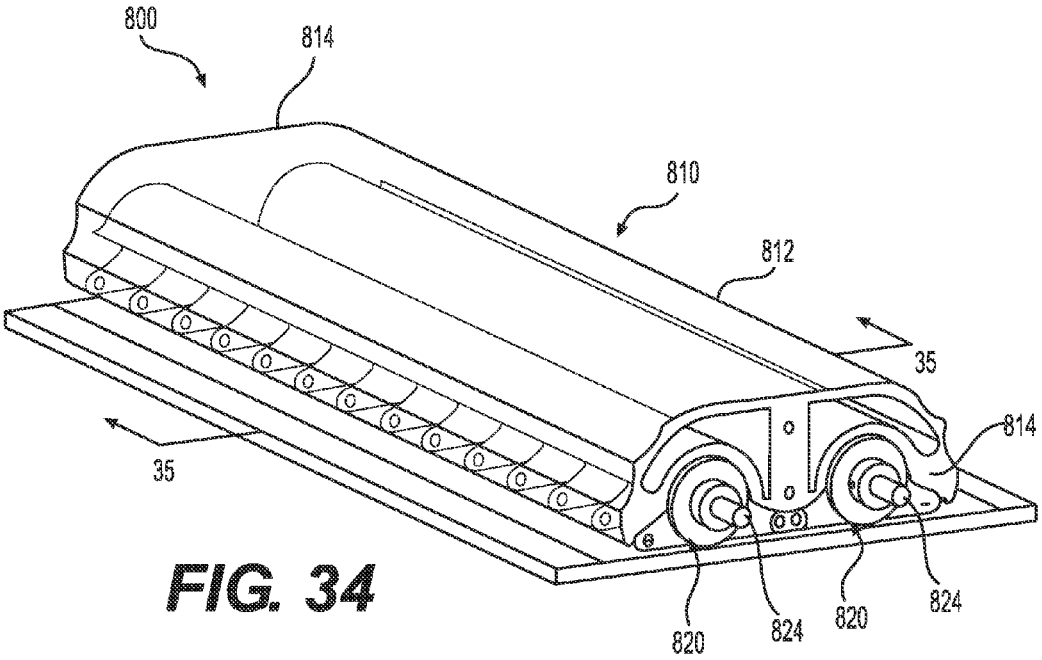
FIG. 34 is a top perspective view of the hand held portable magnetizer device shown in FIGS. 29-32.
Figure 35:
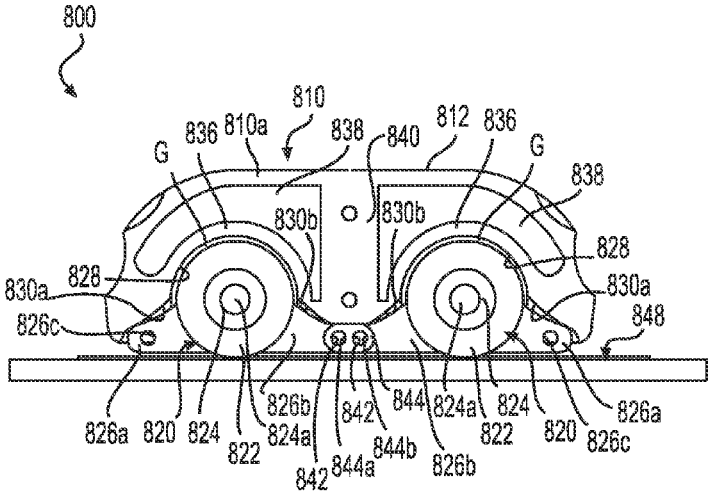
FIG. 35 is a cross-sectional view of the hand held portable magnetizer device, as indicated in FIG. 34.

The detailed arrangement of the hand held portable high energy magnetizer device 800 is shown in FIGS. 34 and 35.

The magnetic rollers 820 includes the magnetic stacks 820 mounted on the shafts 824. The ends 824*a* of the shafts 824 are mounted within bearings 834 (e.g. ball bearings) disposed within the end plates 810*b*. Specifically, the end plates 810*b* are provided with an inside recesses (not shown) for receiving the bearings 834. For example, the bearings 834 are press fit (i.e. interference fit) within the inside recesses for rotatably supporting the ends 824*a* of the shafts 824.

The housing 810 is provided with a pair of spaced apart recesses 828 in the bottom side 816 thereof for accommodating the magnetic rollers 820, as shown in FIG. 35. For example, the recesses 828 are circular-shaped inner wall portions of the housing 810, which recesses 828 are shaped to follow the outer curvature of the magnetic rollers 820 providing gaps G therebetween. The housing 810 comprises a pair of cavities 838 divided by a stiffener 840. It is noted that the cavities 838 reduce the amount of plastic material required for making the housing 810.

The housing 810 is provided with a plurality of recesses 830*a* and 830*b* in the bottom side thereof for accommodating the ends 826*a* and 826*b* of the stripper plates 826, as shown in FIG. 35. Again, the stripper plates 826 include through holes (not shown) for mounting on the shafts 824. The outer ends 826*a* of the stripper plates 826 are free to move (i.e. not anchored). The stripper plates 826 each include a pair of spaced apart through holes 826*c* located in the stripper plate ends 826*a* and 826*b*.

A pair of spaced apart stabilizer bars 842 are provided for stabilizing movement of the stripper plates 826. Specifically, the inner ends of 826*b* of the stripper plates 826 are mounted on the stabilizer bars 842 extending through the through holes 826*c* of the stripper plates 826. The stabilizer bars 842 extend through a pair of through holes 844*a* in end plates 844 (FIG. 35). In addition, the stabilizer bars 842 are supported in through holes (not shown) provided along a length of a zigzag-shaped center support 846 located on the bottom side 816 of the housing, as shown in FIG. 32. This arrangement limits the movement of the stripper plates 826 by anchoring the inner ends 826*b* thereof as shown.

Figure 36:
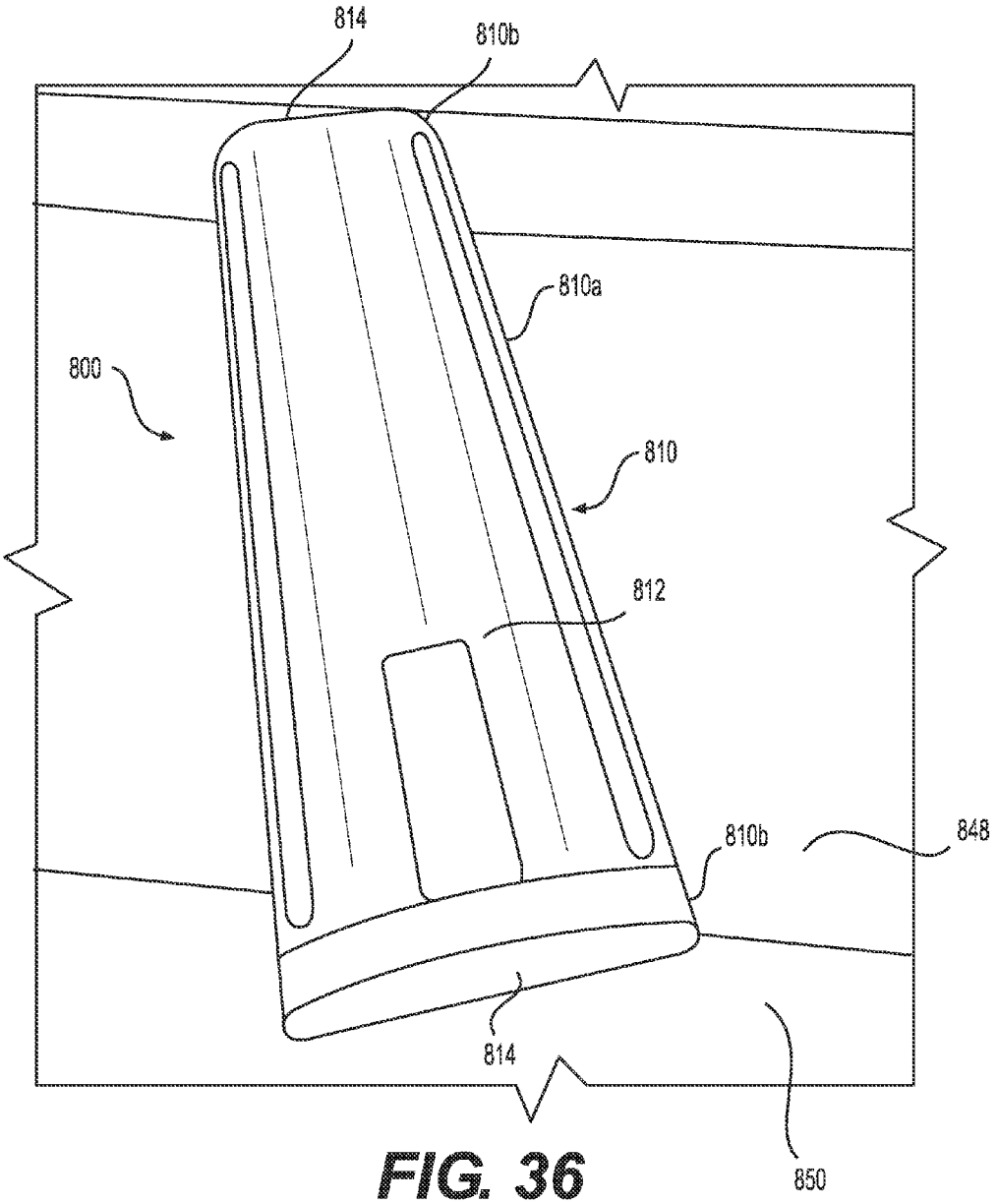
FIG. 36 is a perspective view of the hand held portable magnetizer device shown in FIGS. 29-35 is use.

The use of the hand held portable high energy magnetizer device 800 is shown in FIGS. 34 thru 36.

For example, a flexible magnetizable sheet 848 is laid onto a stationary work support 850 to begin the process. For example, the work support 850 can be a steel sheet (e.g. ¼" thick sheet of Cold Rolled steel). To get high energy pulls from the flexible magnetizable sheet 848, the flexible magnetizable sheet 848 needs to be on the steel sheet while the magnetizer is in use, or otherwise full strength is not achieved. The hand held portable high energy magnetizer device 800 is then positioned on top of the flexible magnetizable sheet 848, and then a user pushes or pulls the hand held portable high energy magnetizer device 800 along the length of the flexible magnetizable sheet 848 to magnetize same.

Although the applicant has described applicant's preferred embodiments of this invention, it will be understood that the broadest scope of this invention includes modifications such as diverse shapes, sizes, and materials. Such scope is limited only by the below claims as read in connection with the above specification. Further, many other advantages of applicant's invention will be apparent to those skilled in the art from the above descriptions and the below claims.

I claim:

1. A manually propelled hand held portable high energy magnetizer device for magnetizing flexible magnetizable sheet material, the device comprising:

a housing having a bottom portion; and a magnetizer disposed within the housing, the magnetizer comprising at least one magnetic roller configured to freely rotate within the housing and at least partially extend below the bottom portion of the housing in contact with an upper surface of the flexible magnetizable sheet material, the at least one magnetic roller is configured or arranged to multipole magnetize the flexible magnetizable sheet as it rotates in contact with the upper surface of the flexible magnetizable material, the magnet roller comprises one or more magnet stacks of circular magnets arranged with alternating polarity, wherein the hand held portable high energy magnetizer device is configured to be positioned on top of the flexible magnetizable sheet material and then a user manually propels the portable high energy magnetizer device by pushing or pulling the hand held portable high energy magnetizer device along a length of the flexible magnetizable sheet material to rotate the at least one magnetic roller in contact with the upper surface of flexible magnetizable sheet material to magnetize same.

2. The device according to claim 1, wherein magnetic roller is rotatably connected to the housing.

3. The device according to claim 1, wherein the magnetizer comprises a pair of spaced apart magnetic rollers connected to the roller.

4. The device according to claim 3, wherein each magnetic roller comprises a plurality of spaced apart magnetic stacks separated by a stripper plate.

5. The device according to claim 4, wherein the magnetic stack comprises a pair of magnetic stacks arranged side-by-side.

6. The device according to claim 2, wherein the at least one magnetic roller is disposed within a recess located in a bottom side of the housing.

7. The device according to claim 2, wherein the at least one magnetic roller comprises a plurality of spaced apart magnetic stacks separated by stripper plates, the magnetic roller and stripper plates being disposed within recesses located on a bottom side of the housing.

8. The device according to claim 7, wherein the at least one magnetic roller is a pair of spaced apart magnetic rollers each located within a recess located in the bottom side of the housing.

9. The device according to claim 8, wherein stripper plates on one magnetic roller is offset from the stripper plates on the other magnetic roller.

10. The device according to claim 9, wherein inner ends of the stripper plates are located in alternating recess along a center support located on the bottom side of the housing.

11. The device according to claim 2, wherein the housing comprises a center portion connected to opposite end plates.

12. The device according to claim 11, wherein the at least one magnetizer roller comprises at least one magnet stack supported on a shaft, the shaft having ends supported by the end plates of the housing.

13. The device according to claim 12, further comprising a bearing disposed within each end plate of the housing to rotatably support the ends of the shaft.

14. The device according to claim 1, wherein the magnetizer comprises at least one permanent magnet.

15. The device according to claim 14, wherein the magnetizer comprises at least one magnetizer roller having a longitudinal axis, the magnetizer roller comprising a plurality of discrete field-producing lamination-sets spaced along the longitudinal axis of the magnetizer roller, each discrete field-producing lamination-set comprising at least one circular magnetic disk and at least one circular flux-conducting spacer magnetically coupled with the at least one circular magnetic disk, each said at least one circular magnetic disk and each the circular flux-conducting spacers being coaxial with the longitudinal axis of the magnetizer roller.

16. The device according to claim 2, wherein the at least one magnetic roller extends below the bottom side of the housing to support the movement of the housing along the flexible magnetizable sheet material while maintaining contact of the magnetic roller with one side of the flexible magnetizable sheet.

17. A manually propelled hand held portable high energy magnetizer system for magnetizing flexible magnetizable sheet material, the system comprising:

a work support comprising a steel sheet for supporting the magnetizable sheet of material; and a manual hand held portable high energy magnetizer device, including:

a housing having a bottom portion; and a magnetizer disposed within the housing, the magnetizer comprising at least one magnetic roller configured to freely rotate within the housing and at least partially extend below the bottom portion of the housing in contact with an upper surface of the flexible magnetizable sheet material, the at least one magnetic roller is configured or arranged to multipole magnetize the flexible magnetizable sheet as it rotates in contact with the upper surface of the flexible magnetizable material, the magnetizer comprising a magnetic field source with alternating pattern of pole pairs, wherein the hand held portable high energy magnetizer device is configured to be positioned on top of the flexible magnetizable sheet material and then a user manually propels the hand held portable high energy magnetizer device by pushing or pulling the hand held portable high energy magnetizer device along a length of the flexible magnetizable sheet to rotate the at least one magnetic roller in contact with the flexible magnetizable sheet and magnetize same.

18. The system according to claim 17, wherein the work support is configured or arranged to hold the flexible magnetizable sheet material stationary when being magnetized by the hand held portable high energy magnetizer device.

19. The system according to claim 17, wherein the work support is configured or arranged to move the flexible magnetizable sheet material when being magnetized by the hand held portable high energy magnetizer device being held stationary by a user.

20. The device according to claim 1, wherein the at least one rotary magnet is driven by the magnetizable sheet material moving relative to the housing.

21. The system according to claim 17, wherein the at least one rotary magnet is driven by the magnetizable sheet material moving relative to the housing.

* * * * *